US011174870B2

(12) United States Patent
Hoshi et al.

(10) Patent No.: US 11,174,870 B2
(45) Date of Patent: Nov. 16, 2021

(54) TURBINE FOR TURBOCHARGER, AND TURBOCHARGER

(71) Applicant: MITSUBISHI HEAVY INDUSTRIES ENGINE & TURBOCHARGER, LTD., Sagamihara (JP)

(72) Inventors: Toru Hoshi, Tokyo (JP); Toyotaka Yoshida, Tokyo (JP); Takao Yokoyama, Tokyo (JP); Bipin Gupta, Tokyo (JP)

(73) Assignee: MITSUBISHI HEAVY INDUSTRIES ENGINE & TURBOCHARGER, LTD., Kanagawa (JP)

( * ) Notice: Subject to any disclaimer, the term of this patent is extended or adjusted under 35 U.S.C. 154(b) by 84 days.

(21) Appl. No.: 16/615,588

(22) PCT Filed: Aug. 10, 2017

(86) PCT No.: PCT/JP2017/029080
§ 371 (c)(1),
(2) Date: Nov. 21, 2019

(87) PCT Pub. No.: WO2019/030892
PCT Pub. Date: Feb. 14, 2019

(65) Prior Publication Data
US 2020/0088212 A1 Mar. 19, 2020

(51) Int. Cl.
*F04D 29/42* (2006.01)
*F02B 33/40* (2006.01)

(52) U.S. Cl.
CPC ..... *F04D 29/4206* (2013.01); *F02B 33/40* (2013.01)

(58) Field of Classification Search
CPC ..... F04D 29/4206; F02B 33/40; F01D 25/14; F01D 25/24; F01D 25/26; F01D 25/16;
(Continued)

(56) References Cited

U.S. PATENT DOCUMENTS 3,411,706 A * 11/1968 Woollenweber, Jr. ..... F01D 25/166 417/407
4,101,241 A * 7/1978 Kasuya ..... F01D 25/186 415/178
(Continued)

FOREIGN PATENT DOCUMENTS

CN 104160129 A 11/2014
EP 1 785613 A2 5/2007
(Continued)

OTHER PUBLICATIONS

Japanese Notice of Reasons for Refusal dated May 26, 2020, for Japanese Application No. 2019-535536, with English translation.
(Continued)

*Primary Examiner* — Thai Ba Trieu
(74) *Attorney, Agent, or Firm* — Birch, Stewart, Kolasch & Birch, LLP

(57) ABSTRACT

A turbine for a turbocharger includes: a turbine impeller coupled to a compressor impeller via a rotational shaft; a turbine casing disposed so as to cover the turbine impeller, the turbine casing including a scroll flow passage and a scroll outlet portion disposed on an inner side, in a radial direction, of the scroll flow passage, for guiding exhaust gas from the scroll flow passage to the turbine impeller; and a back-surface side member disposed so as to face a back surface of the turbine impeller. The back-surface side member includes a protruding portion disposed on an impeller facing surface which faces the back surface of the turbine impeller, the protruding portion protruding toward the back surface and extending in a circumferential direction.

11 Claims, 18 Drawing Sheets

(58) Field of Classification Search
CPC .... F01D 25/125; F01D 25/164; F01D 25/166; F01D 25/167; F01D 25/186; F01D 9/026
USPC ..... 415/204, 148, 164, 175, 178
See application file for complete search history.

(56) References Cited

U.S. PATENT DOCUMENTS

| | | | | | |
|---|---|---|---|---|---|
| 4,157,881 | A * | 6/1979 | Kasuya | F01D 25/125 | 415/175 |
| 4,324,526 | A * | 4/1982 | Berchtold | F01D 17/167 | 415/147 |
| 4,364,717 | A * | 12/1982 | Schippers | F01D 25/125 | 415/180 |
| 4,376,617 | A * | 3/1983 | Okano | F01D 25/14 | 415/178 |
| 4,383,799 | A * | 5/1983 | Okano | F01D 25/243 | 415/214.1 |
| 4,460,284 | A * | 7/1984 | Lauterbach | F01D 25/164 | 415/111 |
| 4,725,206 | A * | 2/1988 | Glaser | F01D 25/125 | 415/175 |
| 4,780,054 | A * | 10/1988 | Yano | F01D 17/165 | 415/164 |
| 4,786,238 | A * | 11/1988 | Glaser | F01D 25/125 | 415/175 |
| 4,809,509 | A | 3/1989 | Hohkita | | |
| 4,880,351 | A * | 11/1989 | Inoue | F01D 17/165 | 415/164 |
| 5,028,208 | A * | 7/1991 | Mitsubori | F01D 25/125 | 415/150 |
| 7,802,429 | B2 * | 9/2010 | Yokoyama | F01D 9/026 | 60/605.3 |
| 8,308,431 | B2 * | 11/2012 | Ueno | F01D 25/16 | 415/178 |
| 10,519,850 | B2 * | 12/2019 | Yokoyama | F01D 9/026 | |
| 2015/0037146 | A1 | 2/2015 | Yamaguchi et al. | | |
| 2015/0330293 | A1 * | 11/2015 | Yokoyama | F01D 17/16 | 415/148 |
| 2016/0290163 | A1 * | 10/2016 | Yokoyama | F01D 25/24 | |
| 2016/0341072 | A1 * | 11/2016 | Chandramohanan | F01D 25/26 | |
| 2016/0356283 | A1 * | 12/2016 | Futae | F02B 39/14 | |

FOREIGN PATENT DOCUMENTS

| | | | |
|---|---|---|---|
| JP | 61-94242 | U | 6/1986 |
| JP | 62-2144232 | A | 9/1987 |
| JP | 2013-15120 | A | 1/2013 |
| JP | 2013-174129 | A | 9/2013 |
| JP | 2014-234713 | A | 12/2014 |
| JP | 2014-234803 | A | 12/2014 |
| JP | 2016-20652 | A | 2/2016 |
| WO | WO 2010/137576 | A1 | 12/2010 |
| WO | WO 2011/067259 | A1 | 6/2011 |
| WO | WO 2015/006329 | A1 | 1/2015 |

OTHER PUBLICATIONS

International Search Report for International Application No. PCT/JP2017/029080, dated Sep. 5, 2017, with English translation.
Written Opinion of the International Searching Authority for International Application No. PCT/JP2017/029080, dated Dec. 12, 2019, with English translation.
Office Action dated Dec. 3, 2020 issued in counterpart Chinese Application No. 201780089489.6.
The Extended European Search Report dated Apr. 8, 2020, for corresponding European Patent Application No. 17921069.5.

* cited by examiner

TURBINE FOR TURBOCHARGER, AND TURBOCHARGER

TECHNICAL FIELD

The present disclosure relates to a turbine for a turbocharger, and a turbocharger.

BACKGROUND ART

Conventionally, for an internal combustion engine for a ship, an automobile, and the like, various inventions of a turbocharger have been made. A turbocharger is driven by utilizing exhaust energy of an internal combustion engine to increase the air supply pressure of the internal combustion engine and increase the output of the internal combustion engine. Such a turbocharger includes a compressor and a turbine disposed across a bearing casing.

Patent Document 1 discloses a turbocharger including a compressor impeller and a turbine impeller coupled to one another via a rotational shaft supported by a bearing.

CITATION LIST

Patent Literature

Patent Document 1: JP2014-234713A

SUMMARY

Problems to be Solved

However, in recent years, with the demand to increase the pressure ratio of a turbocharger, a compressor impeller tends to have a greater diameter compared to a turbine impeller. With an increase in the diameter of a compressor impeller, the thrust force that acts on the back surface of the compressor impeller (force generated in a direction from the turbine toward the compressor) increases compared to the thrust force that acts on the back surface of the turbine impeller (force generated in a direction from the compressor impeller toward the turbine). As a result, the load applied to the bearing increases and mechanical loss occurs over the entire rotor, which causes deterioration of the efficiency of the turbocharger.

An object of at least some embodiments of the present invention is to provide a turbine for a turbocharger and a turbocharger which are effective in reducing mechanical loss that occurs over the entire rotor including the compressor impeller and the turbine impeller while promoting the increase of the pressure ratio of the turbocharger.

Solution to the Problems (1) According to some embodiments of the present invention, a turbine for a turbocharger includes: a turbine impeller coupled to a compressor impeller via a rotational shaft; a turbine casing disposed so as to cover the turbine impeller, the turbine casing including a scroll flow passage and a scroll outlet portion disposed on an inner side, in a radial direction, of the scroll flow passage, for guiding exhaust gas from the scroll flow passage to the turbine impeller; and a back-surface side member disposed so as to face a back surface of the turbine impeller. The back-surface side member includes a protruding portion disposed on an impeller facing surface which faces the back surface of the turbine impeller, the protruding portion protruding toward the back surface and extending in a circumferential direction.

With the above configuration (1), the back-surface side member has a protruding portion that protrudes toward the back surface and extends in the circumferential direction, disposed on the impeller facing surface facing the back surface of the turbine impeller. A flow of exhaust gas introduced into the gap between the back surface of the turbine impeller and the impeller facing surface from the scroll outlet portion is contracted by the protruding portion. Accordingly, the static pressure applied to the back surface of the turbine impeller increases in the vicinity of the protruding portion or at the upstream side of the protruding portion, and a flow that is about to divert the protruding portion hits the back surface of the turbine impeller, whereby it is possible to increase the thrust force that acts on the back surface of the turbine impeller. As a result, even in a case where the thrust force that acts on the back surface of the compressor impeller increases due to the increased diameter of the compressor impeller, the difference between magnitudes of the thrust forces that act on the respective back surfaces of the compressor impeller and the turbine impeller decreases, and thus it is possible to reduce mechanical loss that occurs over the entire rotational shaft.

(2) In some embodiments, in the above configuration (1), the impeller facing surface of the back-surface side member includes: a first region which is positioned at an outer side, in the radial direction, of the protruding portion and which extends in the radial direction; a second region extending along an axial direction from the first region toward the back surface and forming a part of an outer surface of the protruding portion; and a third region positioned at an inner side, in the radial direction, of the second region, the third region forming another part of the outer surface of the protruding portion.

With the above configuration (2), the impeller facing surface of the back-surface side member includes a second region that extends along the axial direction from the first region toward the back surface and forms a part of the outer surface of the protruding portion. The flow passage of exhaust gas narrows rapidly in the second region along the axial direction, and thus it is possible to effectively contract the flow of exhaust gas with the second region. Thus, it is possible to enhance the static pressure applied to the back surface of the turbine impeller even further, and it is also possible to form the flow of exhaust gas that flows toward the back surface of the turbine impeller effectively. Thus, it is possible to enhance the thrust force that acts on the back surface of the turbine impeller effectively.

(3) In some embodiments, in the above configuration (1) or (2), the turbine is configured such that a distance between the back surface of the turbine impeller and the protruding portion is the smallest at a radial-directional position of a tip of the protruding portion.

With the above configuration (3), the flow of exhaust gas introduced into the back surface from the scroll outlet portion has the smallest flow-passage width at the radial-directional position at the tip of the protruding portion. Accordingly, as the static pressure applied to the back surface of the turbine impeller increases near or upstream of the radial-directional position of the tip of the protruding portion, the thrust force that acts on the back surface of the turbine impeller increases.

(4) In some embodiments, in any one of the above configurations (1) to (3), an outermost peripheral portion of the protruding portion is included in a radial-directional position range of not smaller than 0.6 r and not greater than 0.8 r, where r is a radius of the turbine impeller.

According to findings of the present inventors, the flow of exhaust gas that flows into the gap between the back surface of the turbine impeller and the impeller facing surface from the scroll outlet portion has a swirl component, and thus the static pressure that acts on the back surface of the turbine impeller tends to decrease toward the inner side in the radial direction in the outer peripheral region of the turbine impeller.

In this regard, as in the above configuration (4), when r is the radius of the turbine impeller, with the outermost peripheral portion of the protruding portion disposed at the radial-directional position of not smaller than 0.6 r, it is possible to suppress a decrease in the static pressure in the outer peripheral region of the turbine impeller due to the swirl component of the flow of exhaust gas effectively with the protruding portion, and increase the thrust force that acts on the back surface of the turbine impeller effectively.

Furthermore, with the outermost peripheral portion of the protruding portion disposed at the radial-directional position of not greater than 0.8 r, it is possible to ensure a sufficient area of the back surface of the turbine impeller that receives the static pressure enhanced in the vicinity of the protruding portion or at the upstream side of the protruding portion due to the contraction effect of the protruding portion, and enhance the thrust force that acts on the back surface of the turbine impeller effectively.

(5) In some embodiments, in any one of the above configurations (1) to (4), the back-surface side member includes a first tapered surface positioned at an outer side, in the radial direction, of the protruding portion, the first tapered surface being formed to be oblique with respect to the radial direction so as to become closer to the back surface of the turbine impeller inward in the radial direction.

With the above configuration (5), with the first tapered surface formed to be oblique with respect to the radial direction so as to become closer to the back surface of the turbine impeller with distance toward the inner side in the radial direction, it is possible to narrow the flow passage of exhaust gas that flows between the back surface of the turbine impeller and the back-surface side member toward the back surface. By guiding the flow of exhaust gas toward the back surface proactively, it is possible to enhance the pressure in a region closer to the back surface, and it is possible to enhance the thrust force that acts on the back surface of the turbine impeller.

(6) In some embodiments, in the above configuration (5), the back-surface side member includes a second tapered surface positioned at an inner side, in the radial direction, of the first tapered surface, and at an outer side, in the radial direction, of the protruding portion, the second tapered surface being formed to be oblique with respect to the radial direction so as to become farther from the back surface of the turbine impeller inward in the radial direction.

With the above configuration (6), the back-surface side member includes a second tapered surface which is positioned at the inner side, in the radial direction, of the first tapered surface, and at the outer side, in the radial direction, of the protruding portion, and which is formed to be oblique with respect to the radial direction so as to become farther from the back surface of the turbine impeller with distance toward the inner side in the radial direction, and thereby the second tapered surface can expand the flow passage that is narrowed by the first tapered surface. The speed of the flow of exhaust gas is reduced by the expanded flow passage, and thus it is possible to enhance the static pressure that acts on the back surface of the turbine impeller. Thus, it is possible to enhance the thrust force that acts on the back surface of the turbine impeller.

(7) In some embodiments, in any one of the above configurations (1) to (6), the scroll outlet portion includes: a shroud-side wall surface; and a hub-side wall surface positioned at a hub side of the turbine impeller so as to face the shroud-side wall surface. The hub-side wall surface includes, in at least a partial region in the radial direction, a third tapered surface formed to be oblique with respect to the radial direction so as to become farther from an axial direction from the shroud-side wall surface inward in the radial direction.

With the above configuration (7), the hub-side wall surface has a third tapered surface formed to be oblique with respect to the radial direction so as to become farther in the axial direction from the shroud-side wall surface with distance toward the inner side in the radial direction, in at least a partial region in the radial direction, and thus it is possible to weaken the swirl component of exhaust gas from the scroll outlet portion and guide the exhaust gas smoothly into the gap between the back surface of the turbine impeller and the back-surface side member. Accordingly, the flow rate of exhaust gas that flows between the back surface and the back-surface side member increases, and it is possible to increase the pressure at the side of the back surface.

(8) In some embodiments, in the above configuration (7), the third tapered surface forms an angle of not smaller than 10 angular degrees and not greater than 40 angular degrees with the radial direction.

According to the results of study conducted by the present inventors, with the third tapered surface forming an angle of not smaller than 10 angular degrees and not greater than 40 angular degrees with the radial direction, it is possible to increase the thrust force that acts on the back surface of the turbine impeller effectively. The above configuration (8) utilizes the above study results of the present inventors, and it is possible to enhance the thrust force that acts on the back surface of the turbine impeller effectively.

(9) In some embodiments, in the above configuration (7) or (8), the back-surface side member includes a first tapered surface formed to be oblique with respect to the radial direction so as to become closer to the back surface of the turbine impeller inward in the radial direction, and an outermost peripheral portion of the first tapered surface is included in a region surrounded by a first line obtained by inclining a tangent to the hub-side wall surface passing a radially inner end of the third tapered surface by 10 angular degrees in a direction farther from the shroud-side wall surface in the axial direction and a second line obtained by inclining the tangent to the third tapered surface by 10 degrees in a direction closer to the axial direction toward the shroud-side wall surface.

In a case where the outermost peripheral portion of the first tapered surface is in the region outside the first line in the radial direction, the region formed near the outermost peripheral portion of the first tapered surface where little exhaust gas flows (dead water region) increases. Thus, of the flow of exhaust gas from the scroll outlet portion, exhaust gas that stagnates in the dead water region increases, and the effect of the first tapered surface to increase the pressure decreases. Furthermore, in a case where the outermost peripheral portion of the first tapered surface is in the second region inside the second line in the radial direction, the outermost peripheral portion protruding into the flow passage of exhaust gas from the scroll outlet portion impairs the flow of exhaust gas, and may generate pressure loss.

In this regard, with the above configuration (9), it is possible to guide the flow of exhaust gas from the scroll outlet portion smoothly to the back surface of the turbine impeller, and effectively achieve the effect to increase pressure at the back surface.

(10) In some embodiments, in any one of the above configurations (5), (6) to (9), the first tapered surface is a flat surface which forms an angle of not smaller than 5 angular degrees and not greater than 45 angular degrees with the radial direction.

With the above configuration (10), with the first tapered surface being a flat surface that forms an angle of not smaller than 5 angular degrees and not greater than 45 angular degrees with the radial direction, it is possible to narrow the flow passage of exhaust gas at an angle that is suitable to increase the thrust force that acts on the back surface of the turbine impeller, and guide exhaust gas toward the back surface.

(11) In some embodiments, in any one of the above configurations (1) to (10), the back-surface side member includes a heat shield plate disposed so as to face the back surface of the turbine impeller.

With the above configuration (11), by using the heat shield plate for suppressing transmission of heat from the turbine to the bearing casing as the back-surface side member and forming the impeller facing surface described in the above (1) with the heat shield plate, it is possible to increase the thrust force that acts on the back surface of the turbine impeller with a simple configuration.

(12) According to some embodiments of the present invention, a turbocharger includes: the turbine according to any one of (1) to (11); and a compressor including the compressor impeller, the compressor being configured to be driven by the turbine.

With the above configuration (12), as described in the above (1), thanks to the contraction-flow effect of the protruding portion of the back-surface side member, the static pressure applied to the back surface of the turbine impeller increases in the vicinity of the protruding portion or at the upstream side of the protruding portion, and the flow that is about to divert the protruding portion hits the back surface of the turbine impeller. Thus, even in a case where the thrust force that acts on the back surface of the turbine impeller increases and the diameter of the compressor impeller increases, it is possible to reduce mechanical loss that occurs over the entire rotor, and improve the efficiency of the turbocharger.

Advantageous Effects

According to at least one embodiment of the present invention, it is possible to reduce mechanical loss that occurs over the entire rotor including the compressor impeller and the turbine impeller while promoting an increase of the pressure ratio of the turbocharger.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

Figure 1:
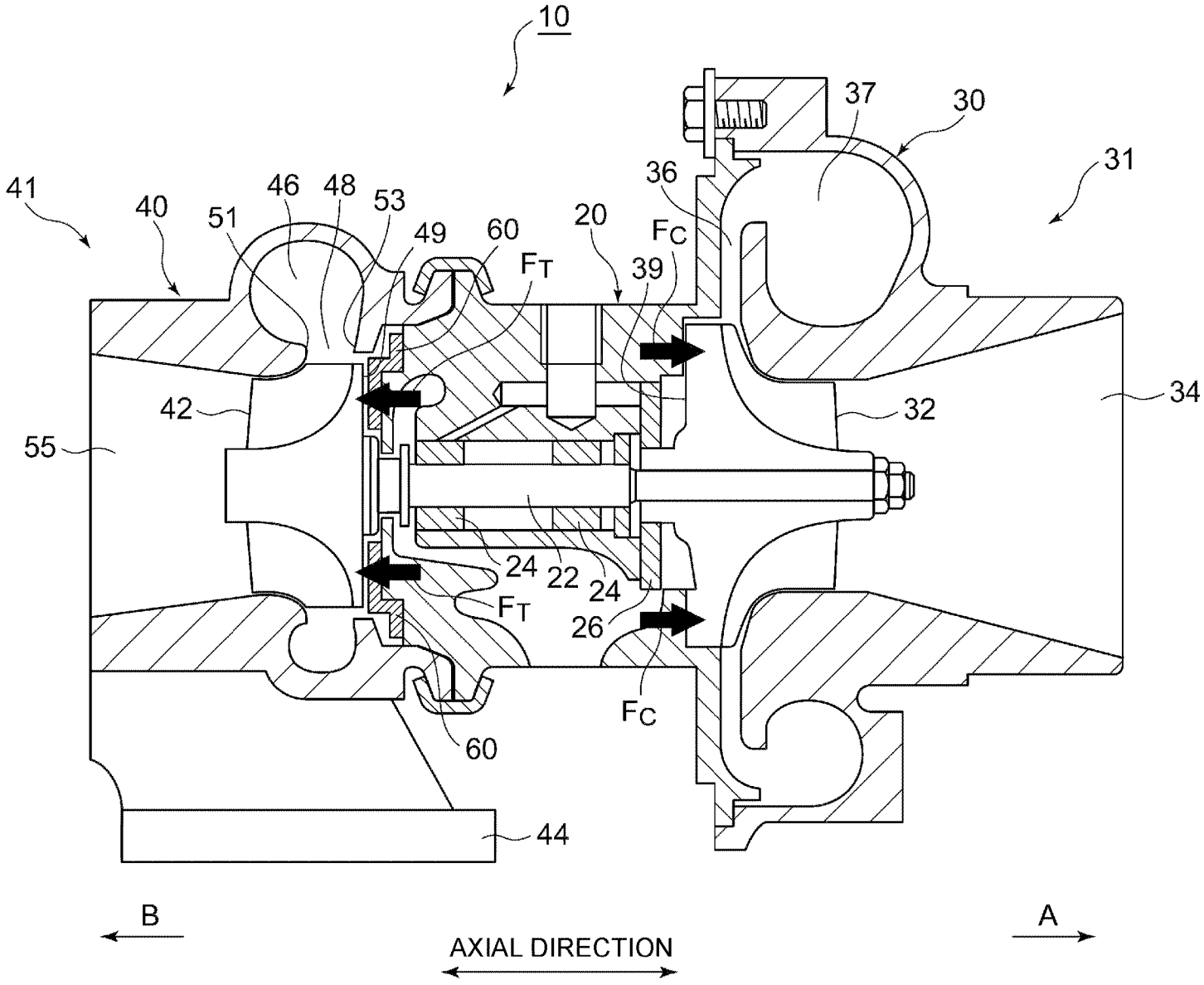
FIG. 1 is a schematic diagram of an overall configuration of a turbocharger including a turbine according to an embodiment of the present invention.

Firstly, with reference to FIG. 1, the overall configuration of a turbocharger 10 to which a turbine 41 according to some embodiments is applied will be described. FIG. 1 is an overall configuration diagram of the turbocharger 10 to which the turbine 41 according to an embodiment is applied.

As depicted in FIG. 1, the turbocharger 10 according to some embodiments of the present invention includes a compressor casing 30 and a turbine casing 40 disposed across a bearing casing 20. A rotational shaft 22 has a turbine impeller 42 housed in the turbine casing 40 on one end, and a compressor impeller 32 housed in the compressor casing 30 on the other end. The rotational shaft 22, the turbine impeller 42, and the compressor impeller 32 are disposed rotatably as an integrated piece. The bearing casing 20 houses a radial bearing 24 and a thrust bearing 26. The radial bearing 24 is configured to support the rotational shaft 22 rotatably, and the thrust bearing 26 supports the rotational shaft 22 so as not to move in the axial direction.

The compressor casing 30 has an air inlet portion 34 formed thereon, for introducing air into the compressor casing 30. The air compressed by rotation of the compressor impeller 32 passes a diffuser flow passage 36 and a compressor scroll flow passage 37 to be pressurized, and is discharged outside the compressor casing 30 via an air outlet portion (not depicted).

The turbine casing 40 has a gas inlet portion 44 formed thereon, for introducing exhaust gas from an engine (not depicted) into the turbine casing 40. The gas inlet portion 44 is connectable to an exhaust manifold (not depicted) of the engine. Further, in the turbine casing 40, a scroll flow passage 46 having a scroll shape is disposed on the outer peripheral portion of the turbine impeller 42 so as to cover the turbine impeller 42. The scroll flow passage 46 is in communication with the gas inlet portion 44, and is formed so as to introduce exhaust gas into the scroll flow passage 46. At the radially inner side of the scroll flow passage 46, a scroll outlet portion 48 is disposed, for guiding exhaust gas from the scroll flow passage 46 to the turbine impeller 42. The scroll outlet portion 48 includes a shroud-side wall surface 51 and a hub-side wall surface 53 positioned at the hub side of the turbine impeller 42 so as to face the shroud-side wall surface 51. The exhaust gas having passed through the turbine impeller 42 is discharged outside the turbine casing 40 via a gas discharge portion 55.

As described above, the turbocharger 10 uses exhaust gas of the engine to rotary drive the turbine impeller 42, and thereby transmits a rotational force to the compressor impeller 32 via the rotational shaft 22, compresses air that enters the compressor casing 30 with a centrifugal force, and supplies the compressed air to the engine.

The turbocharger 10 receives a force in the axial direction (thrust force) during operation. Specifically, at the side of the compressor 31, the pressure at the outlet side of air applies a thrust force $F_C$ in a direction from the turbine 41 toward the compressor 31 (direction of arrow A in FIG. 1) on the back surface 39 of the compressor impeller 32. Furthermore, also at the side of the turbine 41, the pressure at the inlet side of gas applies a thrust force $F_T$ in a direction from the compressor 31 toward the turbine 41 (direction of arrow B in FIG. 1) on the back surface 49 of the turbine impeller 42. These two thrust forces ($F_C$, $F_T$) are oriented in opposite directions, and thus the difference of magnitudes of the two thrust forces ($F_C$, $F_T$) is applied to the thrust bearing 26 for suppressing axial movement as a net load.

However, in a case where the diameter of the compressor impeller 32 is increased due to recent demand, the pressure at the outlet side of air increases, and thus the thrust force $F_C$ in the compressor direction becomes greater than the thrust force $F_T$ in the turbine direction. Thus, the difference of magnitudes of the two thrust forces ($F_C$, $F_T$) increases and the load that the thrust bearing 26 receives increases, which may deteriorate the efficiency of the turbocharger 10 as a whole.

Next, some embodiments related to the above problem will be described.

Figure 2:
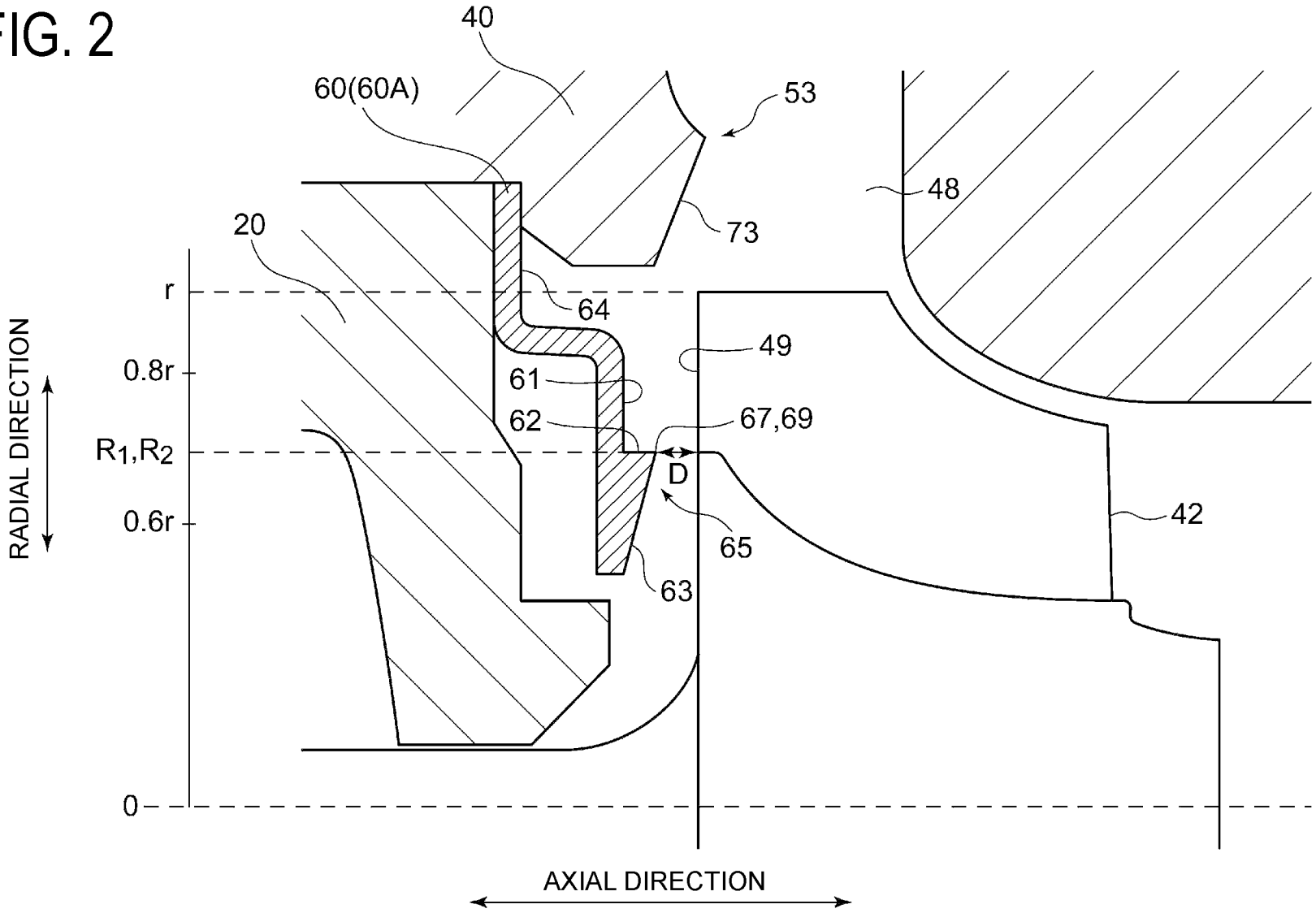
FIG. 2 is an enlarged view of the vicinity of the back-surface side member of a turbine according to some embodiments.
Figure 3:
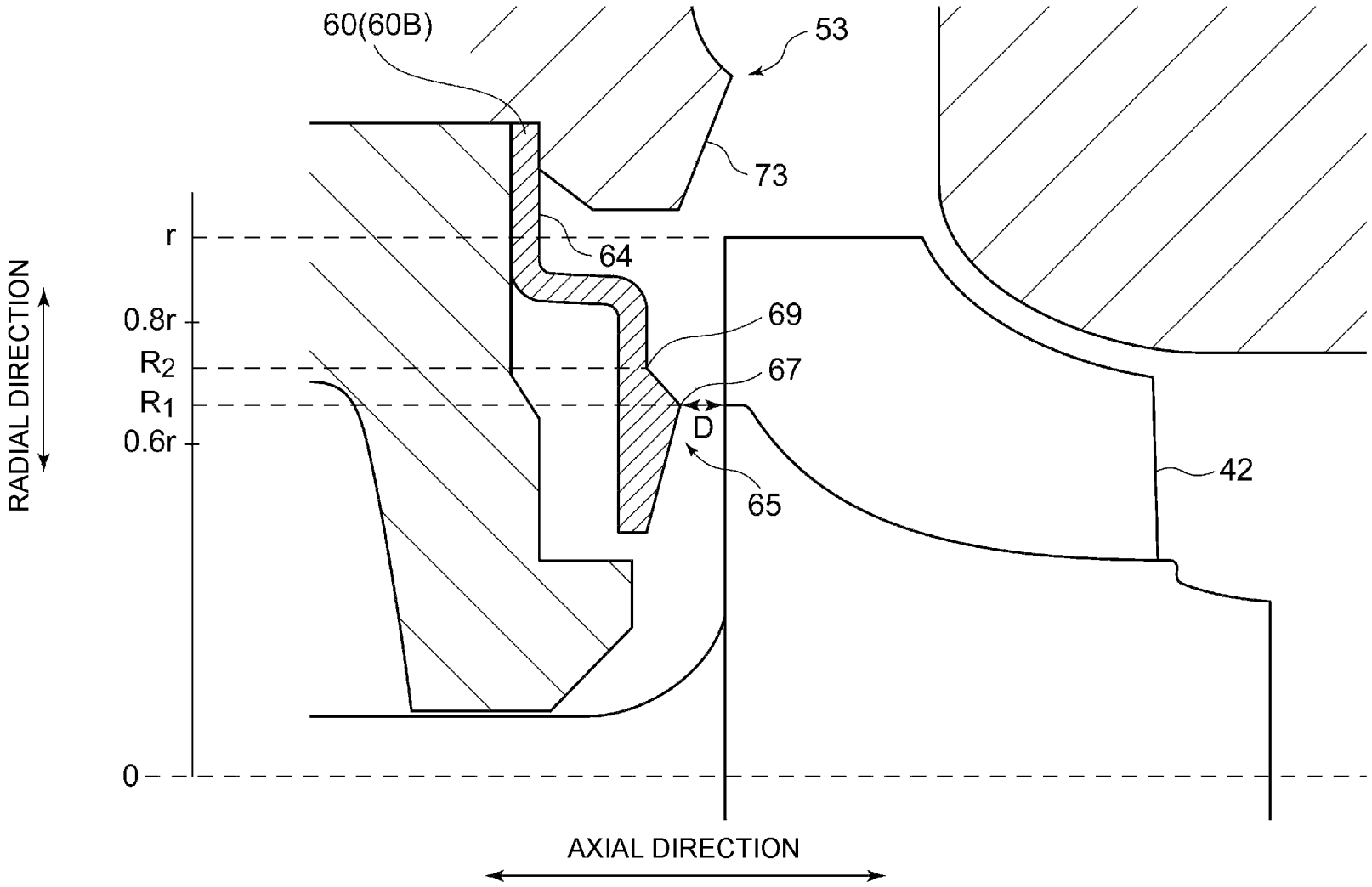
FIG. 3 is a diagram of a modified example of the shape of the back-surface side member according to a modified example.

First, with reference to FIGS. 2 and 3, the shape of the back-surface side member 60 according to some embodiments will now be described. FIG. 2 is an enlarged view of the vicinity of the back surface 49 of the turbine impeller 42 and the back-surface side member 60 of FIG. 1. FIG. 3 is a diagram of a modified example of the shape of the back-surface side member 60 according to a modified example.

As depicted in FIGS. 2 and 3, inside the turbine casing 40, the back-surface side member 60 (60A, 60B) having an annular shape is disposed so as to face the back surface 49 of the turbine impeller 42. The back-surface side member 60 (60A, 60B) is held between the turbine casing 40 and the bearing casing 20.

First, in an illustrative embodiment depicted in FIGS. 2 and 3, the back-surface side member 60 includes a heat shield plate disposed so as to face the back surface 49 of the turbine impeller 42. As described above, by using the heat shield plate for suppressing transmission of heat from the turbine casing 40 to the bearing casing 20 as the back-surface side member 60 and forming an impeller facing surface 64 having the following characteristics with the heat shield plate (60), it is possible to increase the thrust force $F_T$ that acts on the back surface 49 of the turbine impeller 42 with a simple configuration.

As depicted in FIGS. 2 and 3, in the turbine 41 according to some embodiments, the back-surface side member 60 has a protruding portion 65 that protrudes toward the back surface 49 and extends in the circumferential direction, disposed on the impeller facing surface 64 facing the back surface 49 of the turbine impeller 42. The protruding portion 65 extends in arc shape along the circumferential direction, when seen from the axial direction of the turbine 41. Further, the protruding portion 65 may be disposed only in a partial circumferential-directional range of the back-surface side member 60, or continuously over the entire periphery of the back-surface side member 60.

According to the present embodiment, a flow of exhaust gas introduced into the gap between the back surface 49 of the turbine impeller 42 and the impeller facing surface 64 from the scroll outlet portion 48 is contracted by the protruding portion 65. Since the flow of exhaust gas stagnates due to the narrowed flow passage, the static pressure applied to the back surface 49 of the turbine impeller 42 increases near the protruding portion 65 or upstream of the protruding portion 65 (from comparison of the CFD analysis results in FIGS. 5A and 5B described below, it can be seen that the static pressure increases near and upstream of the protruding portion 65 in the turbine 41 according to the present embodiment), and a flow that is about to divert the protruding portion 65 hits the back surface 49 of the turbine impeller. As a result, it is possible to enhance the thrust force $F_T$ that acts on the back surface 49 of the turbine impeller 42.

Herein, the technical advantages of the protruding portion 65 of the turbine 41 according to the embodiment depicted in FIGS. 2 and 3 will be described further, in comparison to the results of CFD analysis that the present inventors conducted on a turbine according to a comparative example.

Figure 4A:
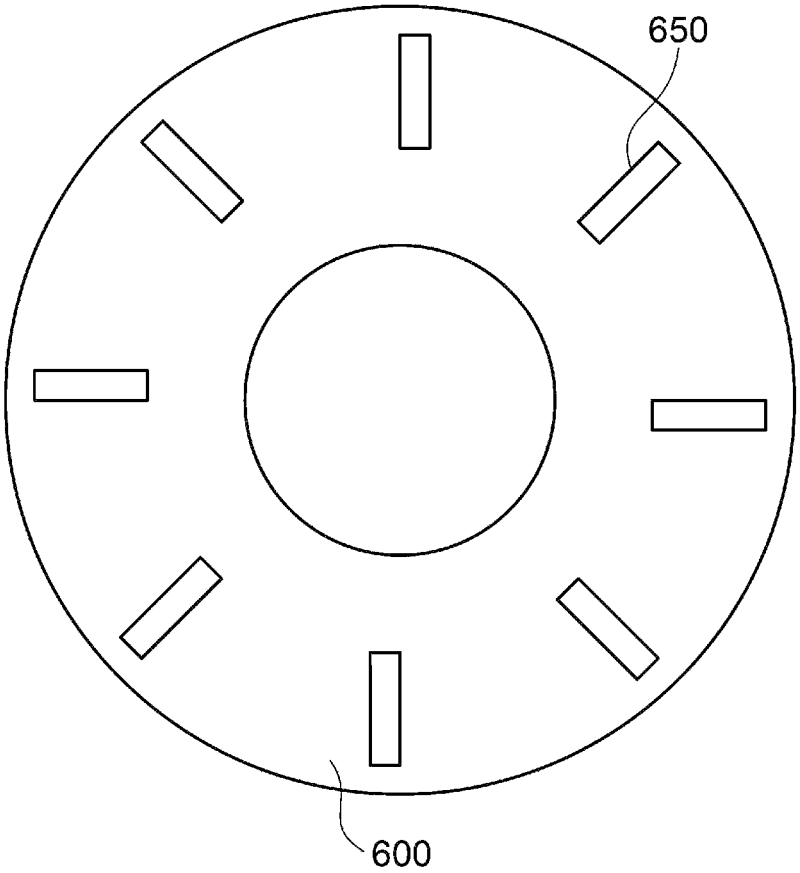
FIG. 4A is a diagram showing the shape of the protruding portion of a turbine according to a comparative example.
Figure 4B:
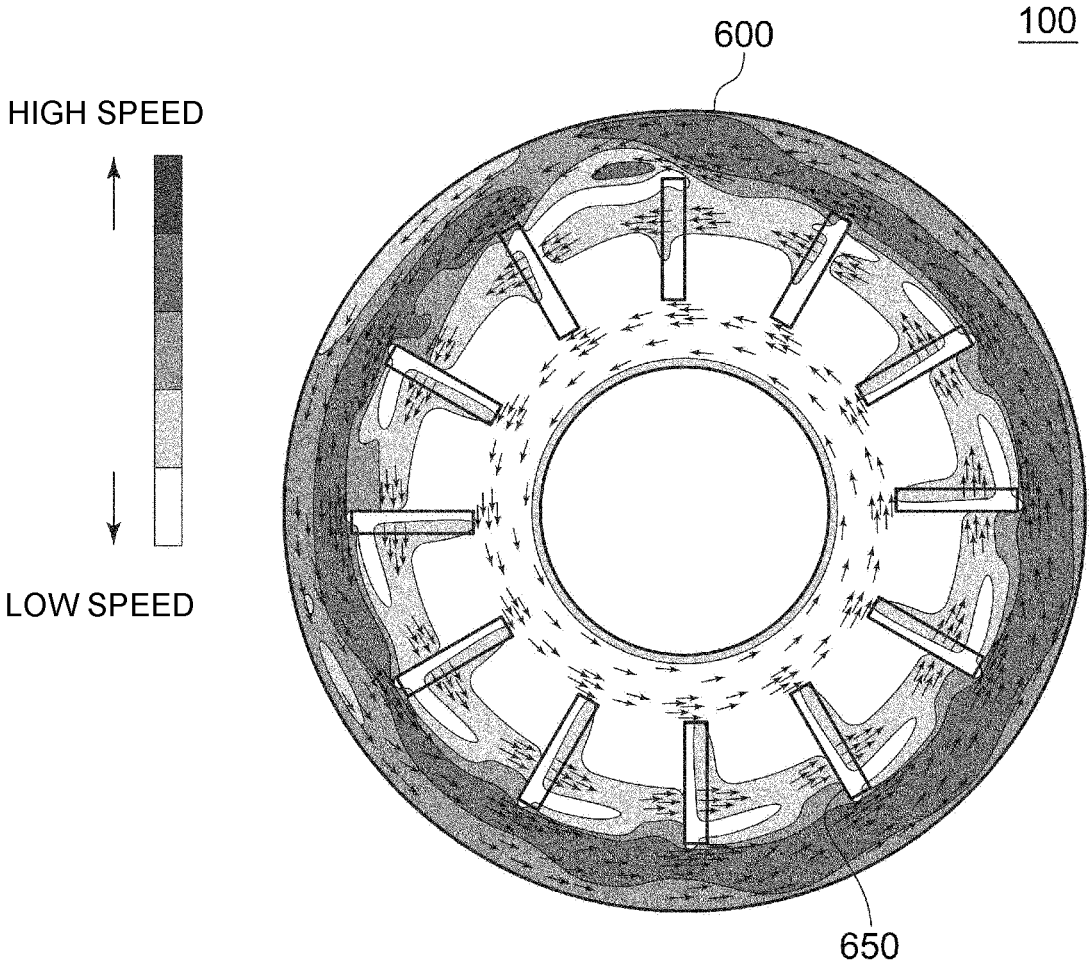
FIG. 4B is a diagram showing the circumferential velocity distribution obtained by CFD analysis on the turbine depicted in FIG. 4A.
Figure 4C:
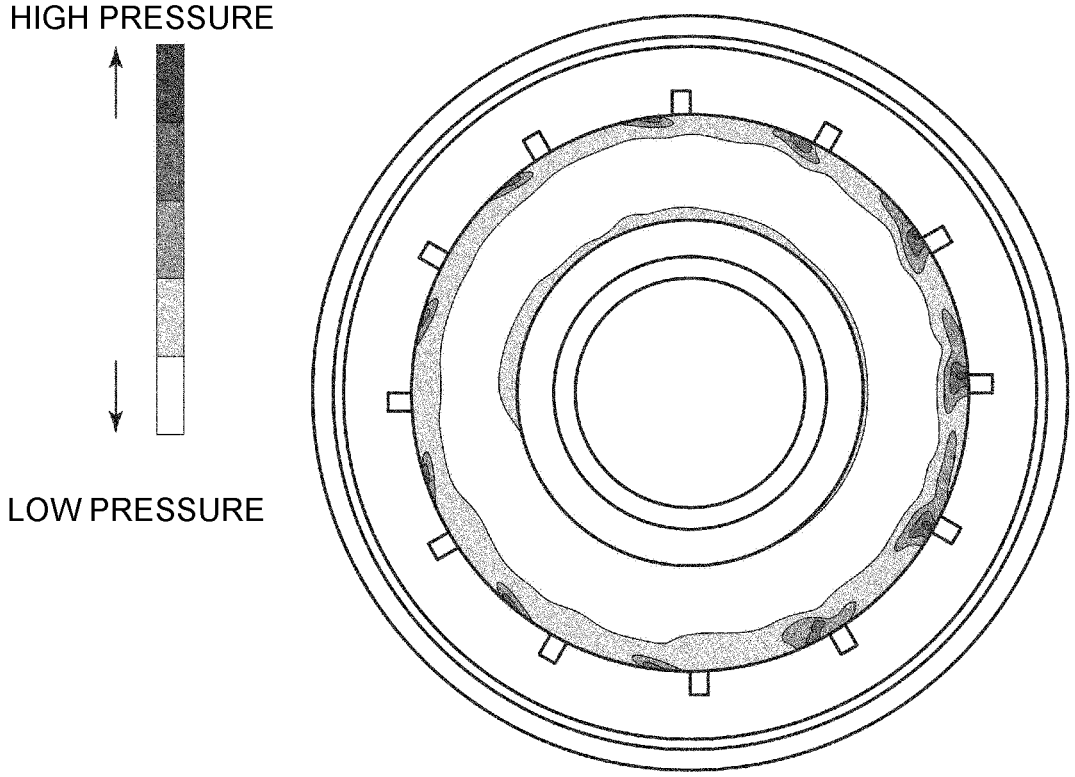
FIG. 4C is a diagram showing the total pressure distribution obtained by CFD analysis on the turbine depicted in FIG. 4A.
Figure 4D:
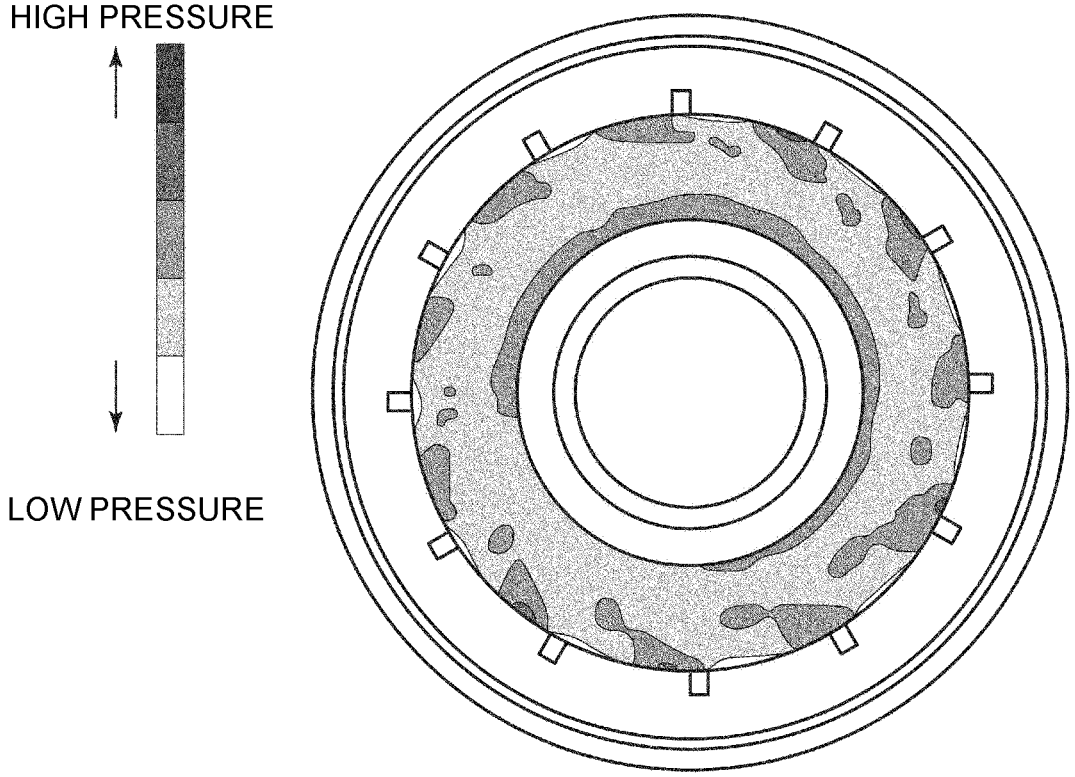
FIG. 4D is a diagram showing the static pressure distribution obtained by CFD analysis on the turbine depicted in FIG. 4A.

FIG. 4A is a diagram showing the shape of the protruding portion of a turbine according to a comparative example. FIGS. 4B to 4D are diagrams showing results of CFD analysis on the turbine depicted in FIG. 4A. As depicted in FIG. 4A, in the turbine 100, the back-surface side member 600 facing the turbine impeller includes a plurality of protruding portions 650 disposed in the circumferential direction. Each protruding portion 650 is disposed along the radial direction so as to protrude toward the turbine impeller. The protruding portion 650 having such a shape is capable of reducing the swirl component of the flow of exhaust gas that flows into the gap between the impeller facing surface 664 of the back-surface side member 600 and the turbine impeller back surface. However, as can be seen from FIG. 5B, in the gap between the impeller facing surface 664 of the back-surface side member 600 and the turbine impeller back surface, the protruding portion 650 causes a significant turbulence of flow. As a result, it was found that the total pressure (see FIG. 4C) at the side of the impeller back surface and the static pressure (see FIG. 4D) can be rather reduced by the protruding portion 650.

In this regard, with the turbine 41 according to the above described embodiment, the protruding portion 65 has a shape that extends in the circumferential direction, and thus it is possible to increase the thrust force $F_T$ effectively while suppressing turbulence of the flow of exhaust gas between the back surface 49 of the turbine impeller 42 and the impeller facing surface 64.

As described above, even in a case where the thrust force $F_C$ that acts on the back surface 39 of the compressor impeller 32 increases due to the increased diameter of the compressor impeller 32, the difference between magnitudes of the thrust forces ($F_C$, $F_T$) that act on the respective back surfaces (39, 49) of the compressor impeller 32 and the turbine impeller 42 decreases, and thus it is possible to reduce mechanical loss that occurs over the entire rotational shaft 22.

In some embodiments, as depicted in FIG. 2, the impeller facing surface 64 of the back-surface side member 60 includes: a first region 61 positioned at the outer side, in the radial direction, of the protruding portion 65, extending along the radial direction; a second region 62 extending along the axial direction from the first region 61 toward the back surface 49 and forming a part of the outer surface of the protruding portion 65; and a third region 63 positioned at the inner side, in the radial direction, of the second region 62, and forming another part of the outer surface of the protruding portion 65.

According to the present embodiment, the second region 62 extends along the axial direction, and thus it is possible to narrow the flow passage of exhaust gas rapidly in the second region 62. Accordingly, it is possible to contract the flow of exhaust gas effectively, and thus it is possible to enhance the static pressure applied to the back surface 49 of the turbine impeller 42 even further, and it is possible to form the flow of exhaust gas that hits the back surface 49 effectively. Thus, it is possible to enhance the thrust force $F_T$ that acts on the back surface 49 of the turbine impeller 42 effectively.

In some embodiments, as depicted in FIGS. 2 and 3, the distance D between the back surface 49 of the turbine impeller 42 and the protruding portion 65 is the smallest at the radial-directional position $R_1$ of the tip 67 of the protruding portion 65.

With the above configuration, the flow of exhaust gas introduced into the back surface 49 from the scroll outlet portion 48 has the smallest flow-passage width at the radial-directional position $R_1$ at the tip 67 of the protruding portion 65. Accordingly, as the static pressure applied to the back surface 49 of the turbine impeller 42 increases near or upstream of the radial-directional position $R_1$ of the tip 67 of the protruding portion 65, the thrust force $F_T$ that acts on the back surface 49 of the turbine impeller 42 increases.

Figure 5A:
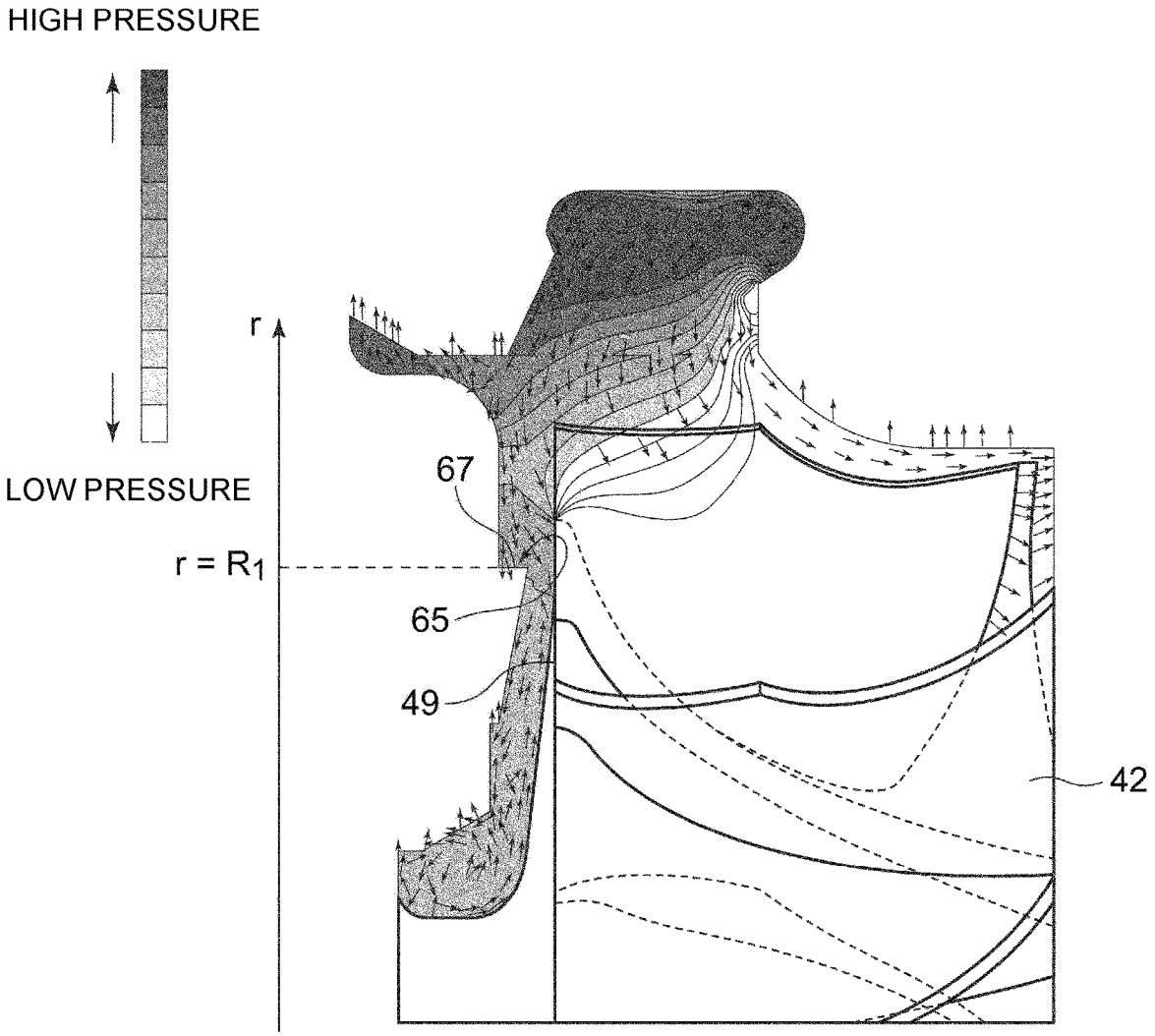
FIG. 5A is a diagram showing the CFD analysis result related to the turbine depicted in FIG. 2.
Figure 5B:
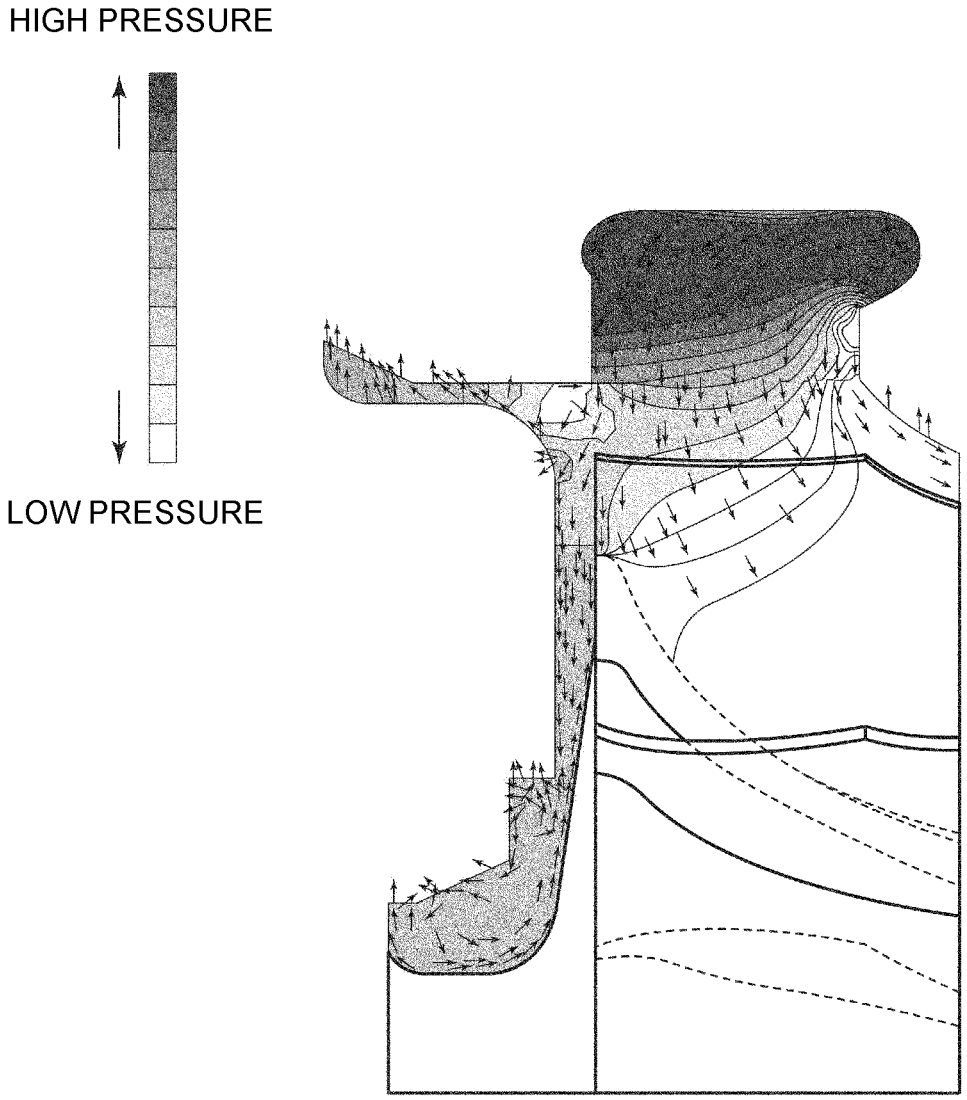
FIG. 5B is a diagram showing the CFD analysis result related to the turbine according to a comparative example.

FIG. 5A is a diagram showing the CFD analysis result related to the turbine 41 depicted in FIG. 2. FIG. 5B is a diagram showing the CFD analysis result related to the turbine according to a comparative example.

As clearly shown in comparison of FIGS. 5A and 5B, in the turbine 41 whose flow passage width is the smallest at the tip 67 of the protruding portion 65, the static pressure applied to the back surface 49 of the turbine impeller 42 is higher than that in the comparative example, near or upstream of the radial-directional position $R_1$ of the tip 67 of the protruding portion 65. Thus, in the case of the turbine 41, the thrust force $F_T$ that acts on the back surface 49 of the turbine impeller 42 is relatively high.

In some embodiments, as depicted in FIGS. 2 and 3, the radial-directional position $R_2$ of the outermost peripheral portion 69 of the protruding portion 65 is included in the radial-directional position range of not smaller than 0.6 r and not greater than 0.8 r, where r is the radius of the turbine impeller 42.

According to findings of the present inventors, the flow of exhaust gas that flows into the gap between the back surface 49 of the turbine impeller 42 and the impeller facing surface 64 from the scroll outlet portion 48 has a swirl component, and thus the static pressure that acts on the back surface 49 of the turbine impeller 42 tends to decrease toward the inner side in the radial direction in the outer peripheral region of the turbine impeller 42.

In this regard, as in the present embodiment, when r is the radius of the turbine impeller 42, with the radial-directional position $R_2$ of the outermost peripheral portion 69 of the protruding portion disposed at the radial-directional position of not smaller than 0.6 r, it is possible to suppress a decrease in the static pressure in the outer peripheral region of the turbine impeller 42 due to the swirl component of the flow of exhaust gas effectively with the protruding portion 65, and increase the thrust force $F_T$ that acts on the back surface 49 of the turbine impeller 42 effectively.

Furthermore, with the outermost peripheral portion 69 of the protruding portion 65 disposed at the radial-directional position of not greater than 0.8 r, it is possible to ensure a sufficient area of the back surface 49 that receives the static pressure enhanced near the protruding portion 65 or upstream of the protruding portion 65 due to the contraction effect of the protruding portion 65, and enhance the thrust force $F_T$ that acts on the back surface 49 of the turbine impeller 42 effectively.

Furthermore, while the radial-directional positions ($R_1$, $R_2$) of the tip 67 of the protruding portion 65 and the outermost peripheral portion 69 are the same in the illustrative embodiment depicted in FIG. 2, some embodiments are not limited to this. As in the embodiment depicted in FIG. 3, the tip 67 of the protruding portion 65 may be positioned at the inner side, in the radial direction, of the outermost peripheral portion 69 of the protruding portion 65.

Figure 6:
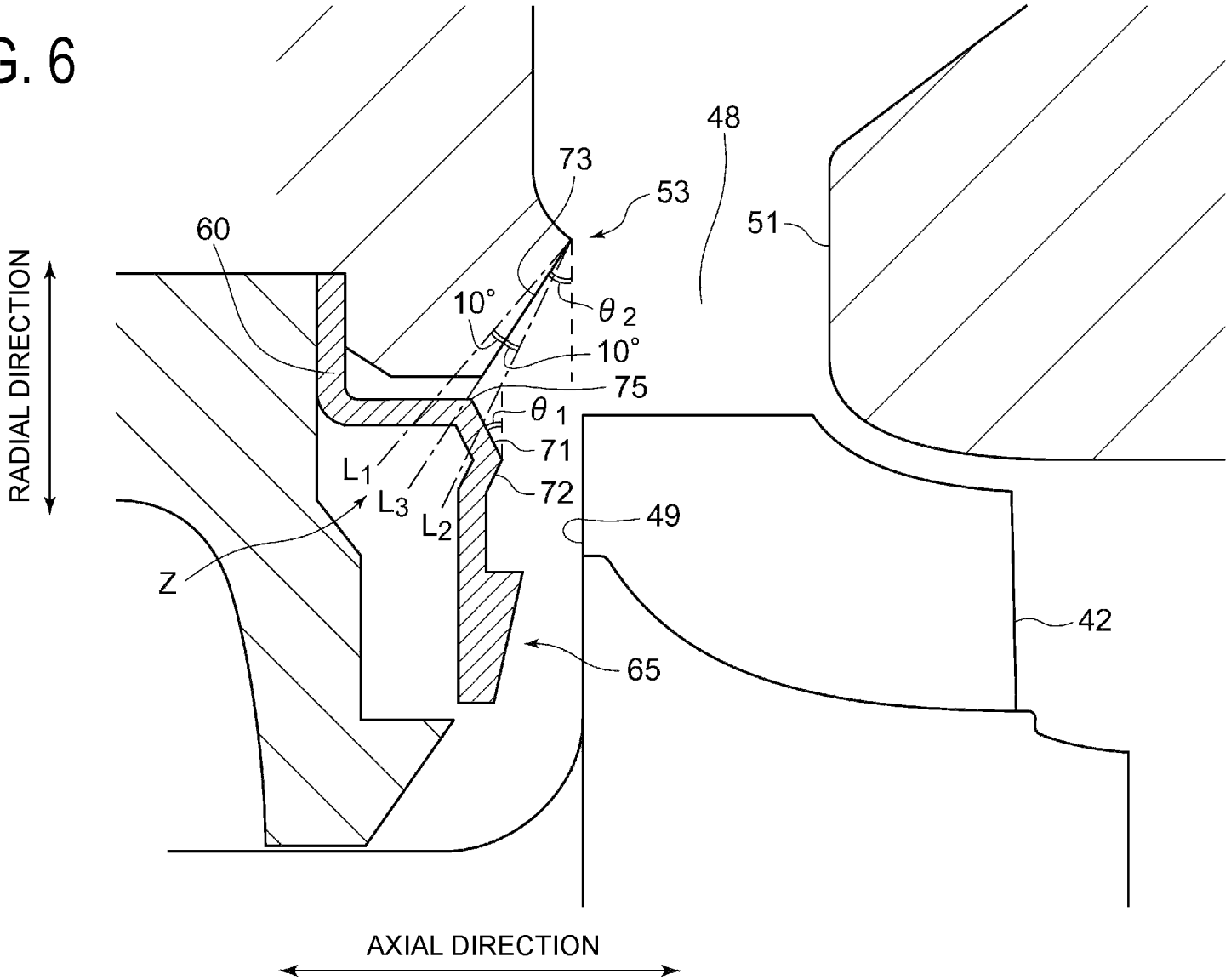
FIG. 6 is an enlarged diagram for describing the position relationship between the scroll outlet portion and the back-surface side member of a turbine according to some embodiments.

Next, some embodiments related to the tapered surface of the back-surface side member 60 will be described with reference to FIG. 6. FIG. 6 is an enlarged diagram for describing the shape of the back-surface side member 60 and the position relationship between the scroll outlet portion 48 and the back-surface side member 60 of a turbine according to some embodiments.

As depicted in FIG. 6, in some embodiments, the back-surface side member 60 includes a first tapered surface 71 which is positioned at the outer side, in the radial direction, of the protruding portion 65, and which is formed to be oblique with respect to the radial direction so as to become closer to the back surface 49 of the turbine impeller 42 with distance toward the inner side in the radial direction.

According to the present embodiment, with the first tapered surface 71, it is possible to narrow the flow passage of exhaust gas that flows between the back surface 49 of the turbine impeller and the back-surface side member 60 toward the back surface 49. By guiding the flow of exhaust gas toward the back surface 49 proactively, it is possible to enhance the pressure in a region closer to the back surface 49, and it is possible to enhance the thrust force $F_T$ that acts on the back surface 49 of the turbine impeller 42.

In an embodiment, the first tapered surface 71 is a flat surface that forms an angle $\theta_1$ of not smaller than 5 angular degrees and not greater than 45 angular degrees with the radial direction. According to the above embodiment, it is possible to narrow the flow passage of exhaust gas at an angle that is suitable to obtain the effect to increase the thrust force $F_T$, and guide the flow of exhaust gas to the back surface 49.

In some embodiments, the back-surface side member 60 includes a second tapered surface 72 which is positioned at the inner side, in the radial direction, of the first tapered surface 71, and at the outer side, in the radial direction, of the protruding portion 65, and which is formed to be oblique with respect to the radial direction so as to become farther from the back surface 49 of the turbine impeller 42 inward in the radial direction.

According to the present embodiment, the second tapered surface 72 can expand the flow passage narrowed by the first tapered surface 71. It is possible to decrease the speed of the flow of exhaust gas with the expanded flow passage, and enhance the static pressure that acts on the back surface 49 of the turbine impeller 42. Thus, with the increased static pressure, it is possible to enhance the thrust force $F_T$ that acts on the back surface 49 of the turbine impeller 42 effectively.

Furthermore, the first tapered surface 71 and the second tapered surface 72 may not necessarily be formed continuously. For instance, another surface formed to maintain the flow passage width to be constant may be included between the first tapered surface 71 and the second tapered surface 72. Furthermore, the first tapered surface 71 may not necessarily be formed from the outermost peripheral portion of the back-surface side member 60.

Figure 7A:
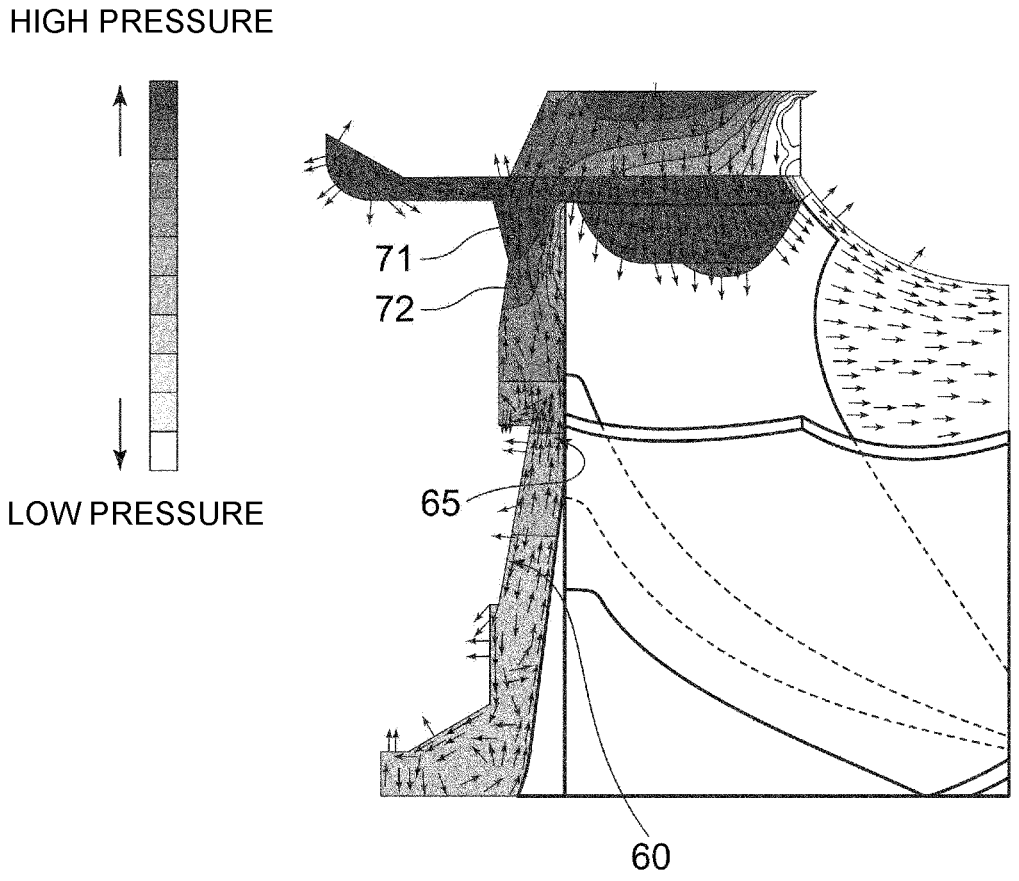
FIG. 7A is a diagram showing the CFD analysis result related to the turbine according to the embodiment depicted in FIG. 6.
Figure 7B:
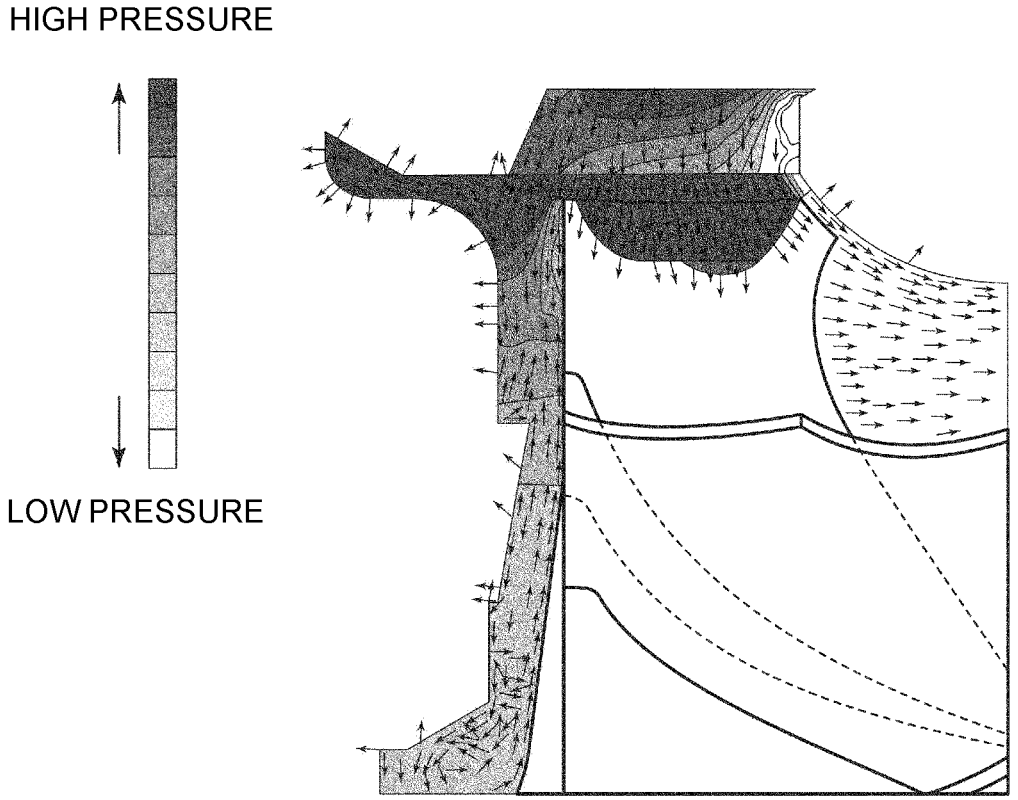
FIG. 7B is a diagram showing the CFD analysis result related to the turbine according to the embodiment depicted in FIG. 2.

FIG. 7A is a diagram showing the CFD analysis result related to the turbine according to the embodiment depicted in FIG. 6. FIG. 7B is a diagram showing the CFD analysis result related to the turbine according to the embodiment depicted in FIG. 2, conducted under the same analysis conditions as those of FIG. 7A.

As clearly shown in comparison of FIGS. 7A and 7B, in a case where the back-surface side member 60 includes the first tapered surface 71 and the second tapered surface 72, the static pressure is higher at the upstream side of the protruding portion 65 than in a case where the back-surface side member 60 does not. This can be considered, as described above, as a result of the increase of the static pressure due to the speed reduction of flow due to expansion of the flow passage by the second tapered surface 72 at the downstream side of the first tapered surface 71, with an increase in the dynamic pressure due to the narrowed flow passage by the first tapered surface 71.

Next, some embodiments related to the shape of the scroll outlet portion 48 will be described below with reference to FIGS. 2, 3 and 6.

In some embodiments, as depicted in FIGS. 2, 3, and 6, the hub-side wall surface 53 at the scroll outlet portion 48 has a third tapered surface 73 formed to be oblique with respect to the radial direction so as to become farther in the axial direction from the shroud-side wall surface 51 toward the inner side in the radial direction, in at least a partial radial-directional region.

According to the present embodiment, with the third tapered surface 73, it is possible to weaken the swirl component of exhaust gas from the scroll outlet portion 48 and guide the exhaust gas smoothly into the gap between the back surface 49 of the turbine impeller 42 and the back-surface side member 60. Accordingly, the flow rate of exhaust gas that flows between the back surface 49 and the back-surface side member 60 increases, and it is possible to increase the pressure at the side of the back surface 49.

Figure 8A:
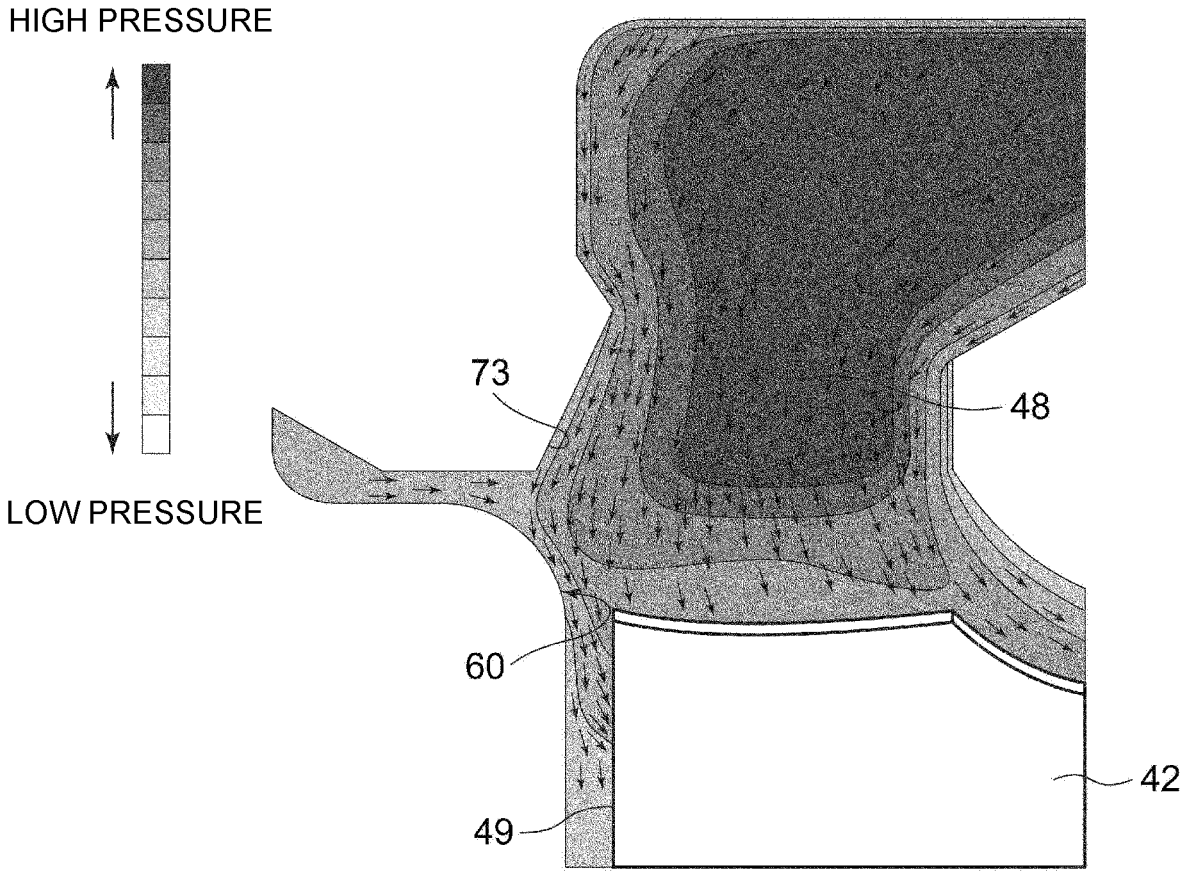
FIG. 8A is a diagram showing the CFD analysis result in a case where the hub-side wall surface of the scroll outlet portion includes a third tapered surface.
Figure 8B:
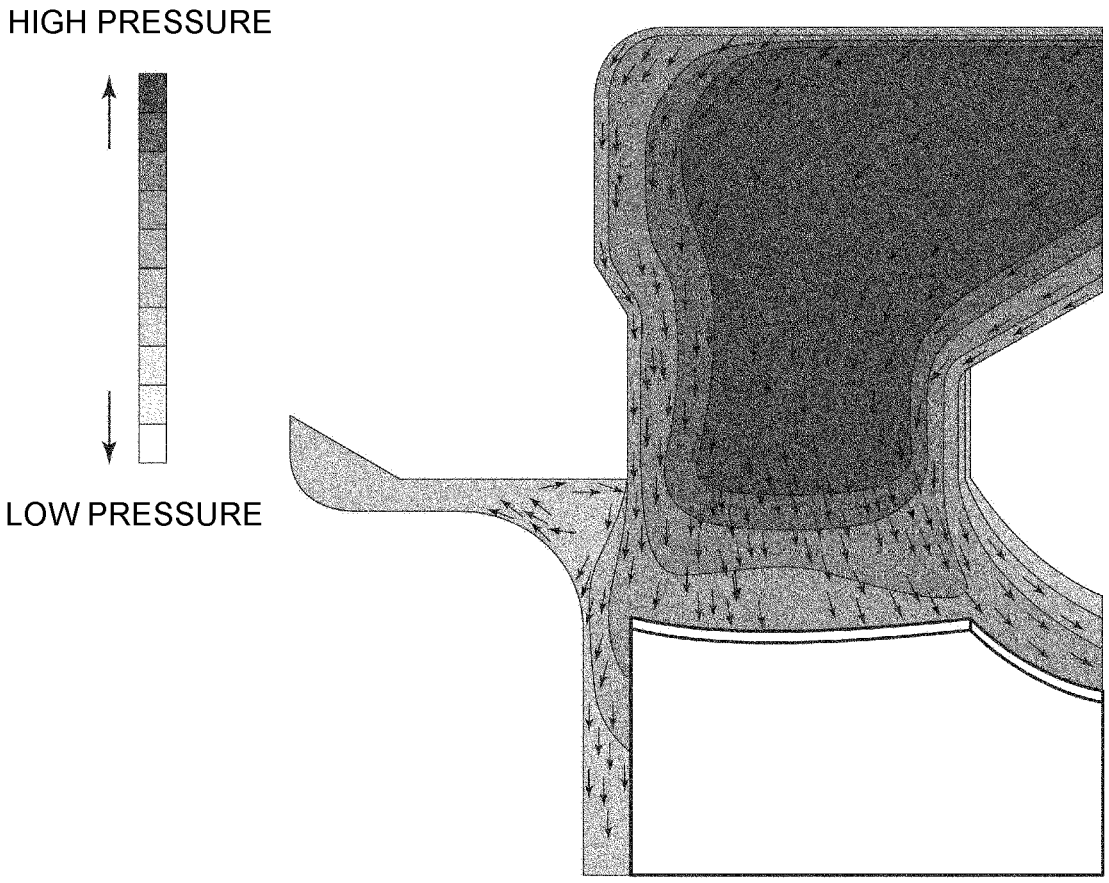
FIG. 8B is a diagram showing the CFD analysis result related to a comparative example.

FIG. 8A is a diagram showing the CFD analysis result in a case where the hub-side wall surface 53 of the scroll outlet portion 48 includes a third tapered surface 73. FIG. 8B is a diagram showing the CFD analysis result of a comparative example.

As clearly shown in the comparison in FIGS. 8A and 8B, with the third tapered surface 73, the swirl flow of exhaust gas from the scroll outlet portion 48 weakens, and exhaust gas from the scroll outlet portion 48 is guided smoothly into the gap between the back surface 49 of the turbine impeller 42 and the back-surface side member 60, and thereby the pressure at the side of the impeller back surface increases.

In an embodiment, the third tapered surface 73 forms an angle of not smaller than 10 angular degrees and not greater than 40 angular degrees with the radial direction. According to the results of study conducted by the present inventors, with the third tapered surface 73 forming an angle of not smaller than 10 angular degrees and not greater than 40 angular degrees with the radial direction, it is possible to increase the thrust force $F_T$ that acts on the back surface 49 of the turbine impeller 42 effectively. The present embodiment utilizes the above study result of the present inventors, and it is possible to enhance the thrust force $F_T$ that acts on the back surface 49 of the turbine impeller 42 effectively.

Furthermore, in an embodiment, the third tapered surface 73 preferably forms an angle of $\theta_2$ from 24 angular degrees to 26 angular degrees with the radial direction, whereby it is possible to achieve a greater thrust force $F_T$.

Figure 9:
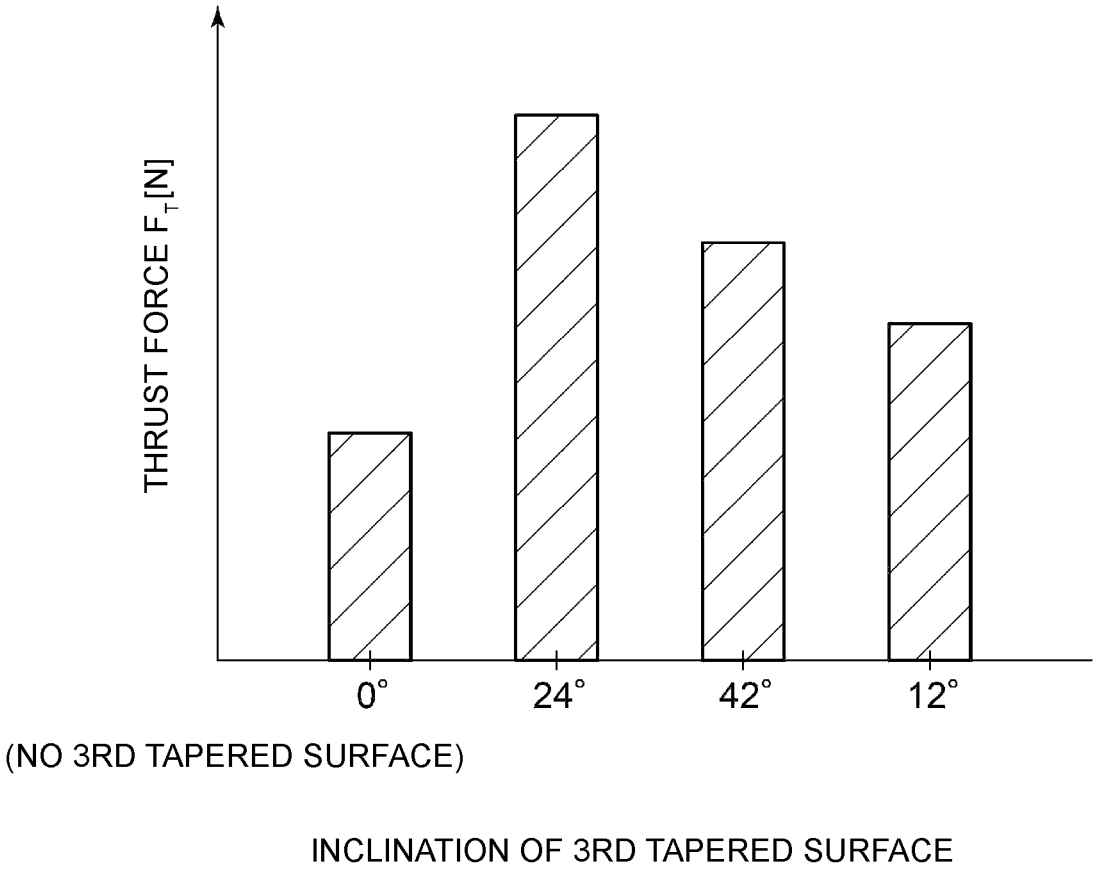
FIG. 9 is a graph showing the relationship between the thrust force and the inclination angle of the third tapered surface with respect to the radial direction.

FIG. 9 is a graph showing the relationship between in the inclination angle of the third tapered surface 73 with respect to the radial direction and the thrust force $F_T$.

As depicted in the drawing, compared to a case where the third tapered surface 73 is not provided, the thrust force $F_T$ is greater in a case where the third tapered surface 73 is provided. Furthermore, when comparing three cases with different inclination angles of the third tapered surface 73 (12, 24, 42 angular degrees), the thrust force $F_T$ is the greatest when the inclination angle of the third tapered surface 73 is 24 angular degrees.

In some embodiments, the outermost peripheral portion 75 of the first tapered surface 71 is included in region Z surrounded by the first line $L_1$ and the second line $L_2$. The first line $L_1$ is obtained by inclining a tangent to the hub-side wall surface 53 passing the radially inner end of the third tapered surface 73 by 10 angular degrees in a direction away from the shroud-side wall surface 51 in the axial direction. The second line $L_2$ is obtained by inclining the tangent to the third tapered surface 73 by 10 degrees in a direction toward the shroud-side wall surface 51 in the axial direction.

Figure 10A:
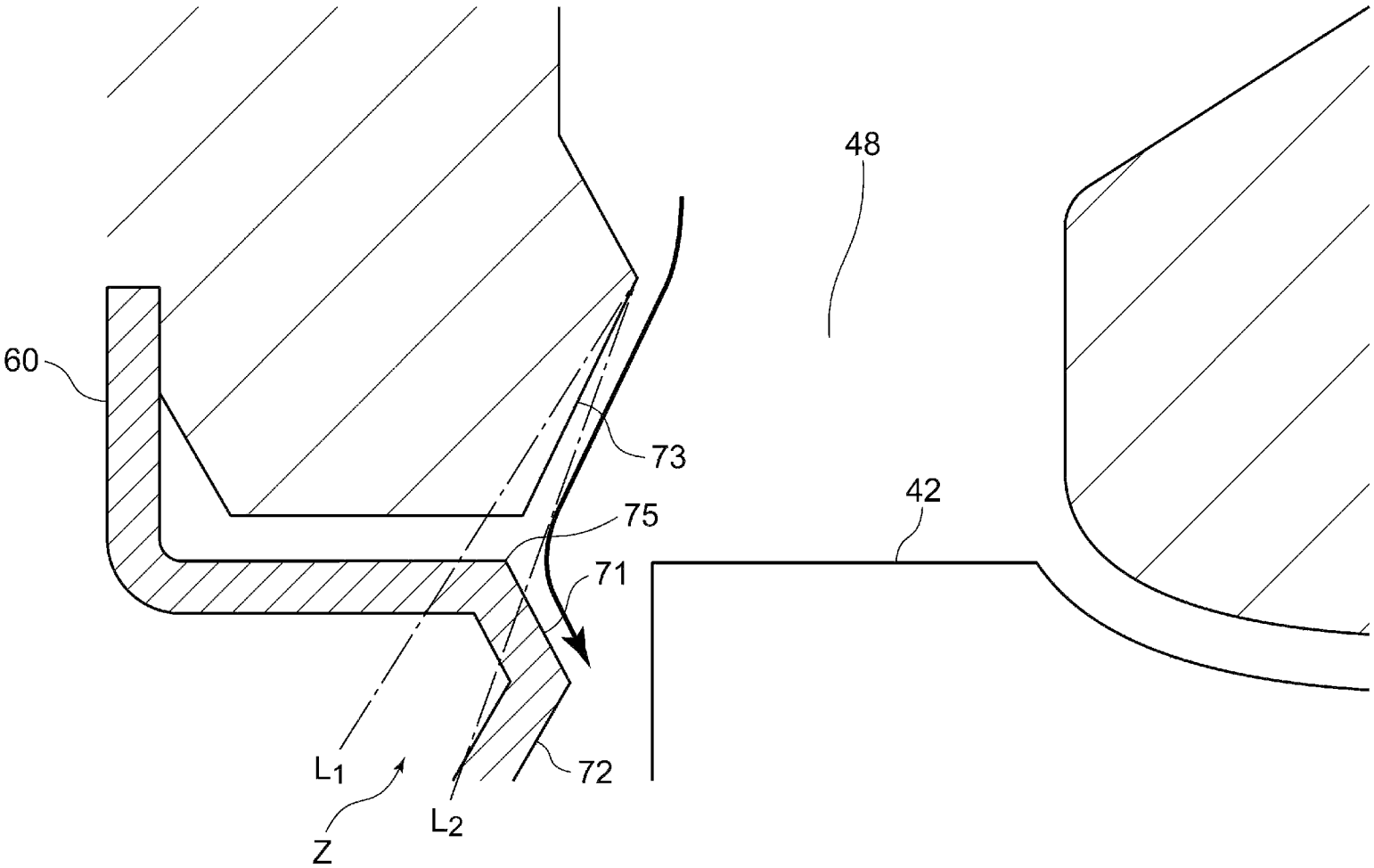
FIG. 10A is a diagram showing the flow of exhaust gas in a case where the outermost peripheral portion of the first tapered surface is included in region Z.
Figure 10B:
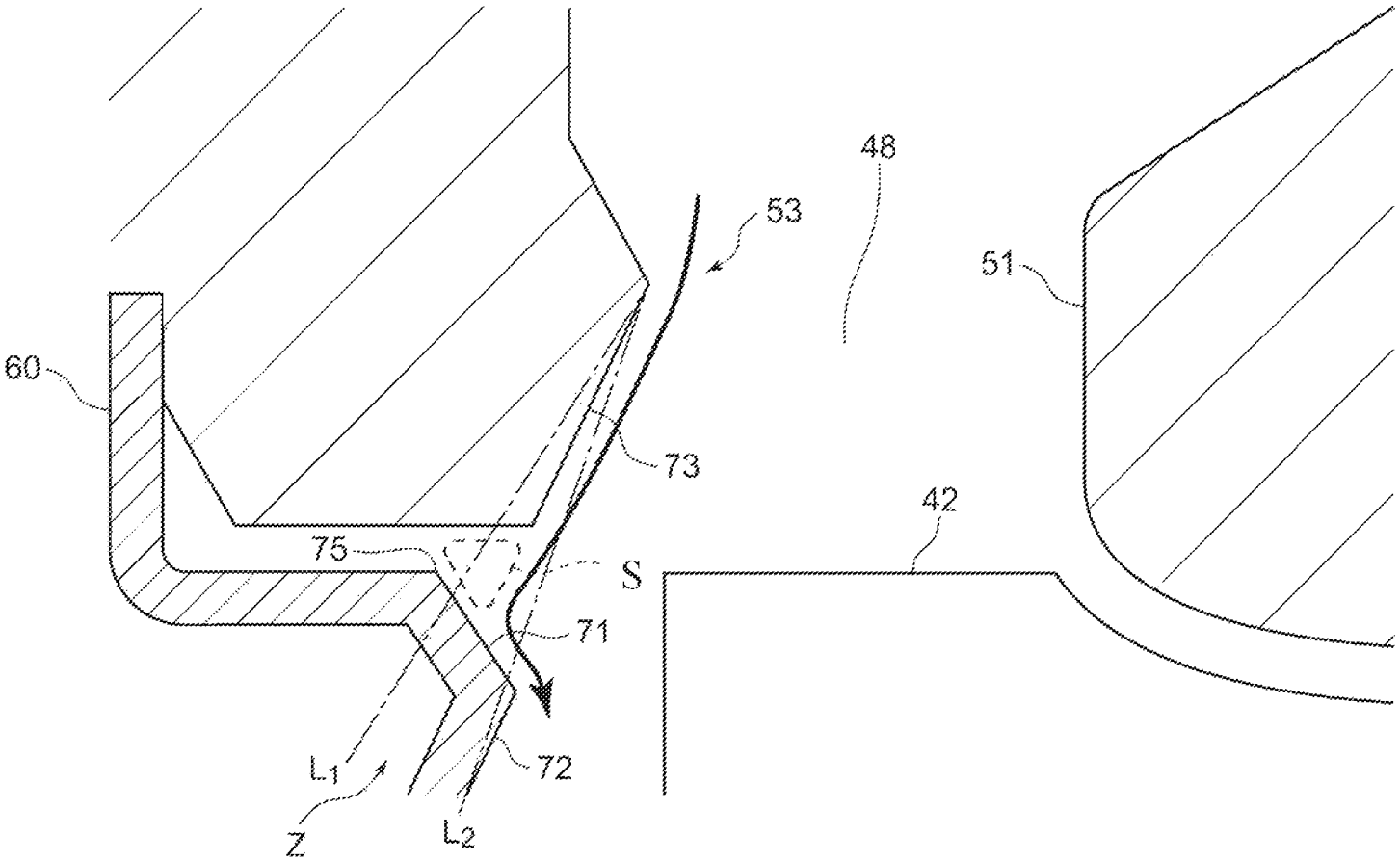
FIG. 10B is a diagram showing the flow of exhaust gas in a case where the outermost peripheral portion of the first tapered surface exists at the outer side, in the radial direction, of region Z.
Figure 10C:
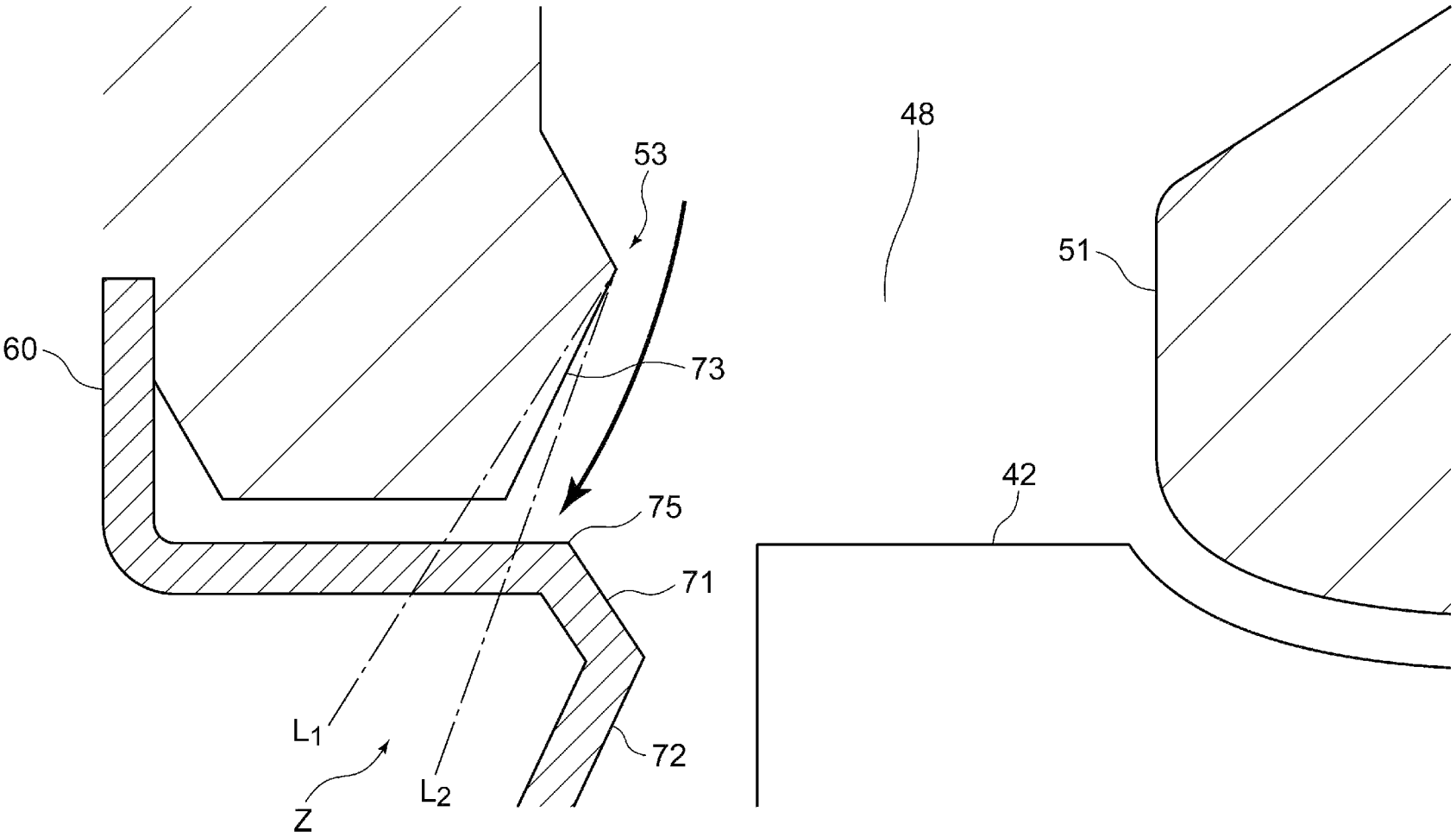
FIG. 10C is a diagram showing the flow of exhaust gas in a case where the outermost peripheral portion of the first tapered surface exists at the inner side, in the radial direction, of region Z.

FIG. 10A is a diagram showing the flow of exhaust gas in a case where the outermost peripheral portion 75 of the first tapered surface 71 is included in region Z. FIG. 10B is a diagram showing the flow of exhaust gas in a case where the outermost peripheral portion 75 of the first tapered surface 71 exists at the outer side, in the radial direction, of region Z. FIG. 10C is a diagram showing the flow of exhaust gas in a case where the outermost peripheral portion 75 of the first tapered surface 71 exists at the inner side, in the radial direction, of region Z.

As depicted in FIG. 10B, in a case where the outermost peripheral portion 75 of the first tapered surface 71 is on the opposite side of region Z across $L_1$ (the outer side, in the radial direction, of region Z), region S formed near the outermost peripheral portion 75 of the first tapered surface 71 where little exhaust gas flows (dead water region) becomes larger. Thus, of the flow of exhaust gas from the scroll outlet portion 48, exhaust gas that stagnates in the dead water region S increases, and the effect of the first tapered surface 71 to increase the pressure decreases. Meanwhile, as depicted in FIG. 10C, in a case where the outermost peripheral portion 75 of the first tapered surface 71 is disposed on the opposite side (inner side in the radial direction) of region Z across $L_2$, the outermost peripheral portion 75 protruding into the flow passage of exhaust gas impairs the flow of exhaust gas, and may generate pressure loss.

In this regard, in a case where the outermost peripheral portion 75 of the first tapered surface 71 is included in region Z, as depicted in FIG. 10A, it is possible to guide the flow of exhaust gas from the scroll outlet portion 48 smoothly to the back surface 49 of the turbine impeller 42, and receive the effect to increase pressure at the back surface 49 effectively.

In an embodiment, the line $L_3$ obtained by extending the tangent to the hub-side wall surface 53 passing the radially inner end of the third tapered surface 73 preferably intersects with the outermost peripheral portion 75 of the first tapered surface 71. According to this embodiment, in the flow passage of exhaust gas from the scroll outlet portion 48 to the side of the back surface 49 of the turbine impeller 42, it is possible to suppress formation of an obstructing structure or the dead water region in the exhaust gas flow passage, and enhance the above pressure increase effect.

Embodiments of the present invention were described in detail above, but the present invention is not limited thereto, and various amendments and modifications may be implemented.

Further, in the present specification, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved. On the other hand, an expression such as "comprise", "include", "have", "contain" and "constitute" are not intended to be exclusive of other components.

REFERENCE SIGNS LIST

10 Turbocharger
20 Bearing casing
22 Rotational shaft
24 Radial bearing
26 Thrust bearing
30 Compressor casing
31 Compressor
32 Compressor impeller
34 Air inlet portion
36 Diffuser flow passage
37 Scroll flow passage (compressor)
39 Back surface (compressor)
40 Turbine casing
41 Turbine
42 Turbine impeller
46 Scroll flow passage (turbine)
48 Scroll outlet portion
49 Back surface (turbine)
51 Shroud-side wall surface
53 Hub-side wall surface
55 Gas discharge portion
60 Back-surface side member
61 First region
62 Second region
63 Third region
64 Impeller facing surface
65 Protruding portion
67 Tip
69 Outermost peripheral portion (protruding portion)
71 First tapered surface
72 Second tapered surface
73 Third tapered surface
75 Outermost peripheral portion (first tapered surface)

The invention claimed is:

1. A turbine for a turbocharger, comprising:

a turbine impeller coupled to a compressor impeller via a rotational shaft;

a turbine casing disposed so as to cover the turbine impeller, the turbine casing including a scroll flow passage and a scroll outlet portion disposed on an inner side, in a radial direction, of the scroll flow passage, for guiding exhaust gas from the scroll flow passage to the turbine impeller; and a back-surface side member disposed so as to face a back surface of the turbine impeller, wherein the back-surface side member includes a protruding portion disposed on an impeller facing surface which faces the back surface of the turbine impeller, the protruding portion protruding toward the back surface and extending in a circumferential direction, and wherein the protruding portion is configured to contract a flow of the exhaust gas flowing into a gap between the back surface and the impeller facing surface from the scroll outlet portion, wherein the back-surface side member includes a first tapered surface positioned at an outer side, in the radial direction, of the protruding portion, the first tapered surface being formed to be oblique with respect to the radial direction so as to become closer to the back surface of the turbine impeller inward in the radial direction.

2. The turbine for a turbocharger according to claim 1, wherein the back-surface side member includes a second tapered surface positioned at an inner side, in the radial direction, of the first tapered surface, and at an outer side, in the radial direction, of the protruding portion, the second tapered surface being formed to be oblique with respect to the radial direction so as to become farther from the back surface of the turbine impeller inward in the radial direction.

3. The turbine for a turbocharger according to claim 1, wherein the first tapered surface is a flat surface which forms an angle of not smaller than 5 angular degrees and not greater than 45 angular degrees with the radial direction.

4. A turbine for a turbocharger comprising:

a turbine impeller coupled to a compressor impeller via a rotational shaft;

a turbine casing disposed so as to cover the turbine impeller, the turbine casing including a scroll flow passage and a scroll outlet portion disposed on an inner side, in a radial direction, of the scroll flow passage, for guiding exhaust gas from the scroll flow passage to the turbine impeller; and a back-surface side member disposed so as to face a back surface of the turbine impeller, wherein the back-surface side member includes a protruding portion disposed on an impeller facing surface which faces the back surface of the turbine impeller, the protruding portion protruding toward the back surface and extending in a circumferential direction, and wherein the protruding portion is configured to contract a flow of the exhaust gas flowing into a gap between the back surface and the impeller facing surface from the scroll outlet portion, wherein the turbine is configured such that a distance between the back surface of the turbine impeller and the protruding portion is the smallest at a radial-directional position of a tip of the protruding portion.

5. A turbine for a turbocharger, comprising:

a turbine impeller coupled to a compressor impeller via a rotational shaft;

a turbine casing disposed so as to cover the turbine impeller, the turbine casing including a scroll flow passage and a scroll outlet portion disposed on an inner side, in a radial direction, of the scroll flow passage, for guiding exhaust gas from the scroll flow passage to the turbine impeller; and a back-surface side member disposed so as to face a back surface of the turbine impeller, wherein the back-surface side member includes a protruding portion disposed on an impeller facing surface which faces the back surface of the turbine impeller, the protruding portion protruding toward the back surface and extending in a circumferential direction, and wherein the protruding portion is configured to contract a flow of the exhaust gas flowing into a gap between the back surface and the impeller facing surface from the scroll outlet portion, wherein an outermost peripheral portion of the protruding portion is included in a radial-directional position range of not smaller than 0.6r and not greater than 0.8r, where r is a radius of the turbine impeller.

6. A turbine for a turbocharger, comprising:

a turbine impeller coupled to a compressor impeller via a rotational shaft;

a turbine casing disposed so as to cover the turbine impeller, the turbine casing including a scroll flow passage and a scroll outlet portion disposed on an inner side, in a radial direction, of the scroll flow passage, for guiding exhaust gas from the scroll flow passage to the turbine impeller; and a back-surface side member disposed so as to face a back surface of the turbine impeller, wherein the back-surface side member includes a protruding portion disposed on an impeller facing surface which faces the back surface of the turbine impeller, the protruding portion protruding toward the back surface and extending in a circumferential direction, and wherein the protruding portion is configured to contract a flow of the exhaust gas flowing into a gap between the back surface and the impeller facing surface from the scroll outlet portion, wherein the scroll outlet portion includes:

a shroud-side wall surface; and a hub-side wall surface positioned at a hub side of the turbine impeller so as to face the shroud-side wall surface, and wherein the hub-side wall surface includes, in at least a partial region in the radial direction, a third tapered surface formed to be oblique with respect to the radial direction so as to become farther from an axial direction from the shroud-side wall surface inward in the radial direction.

7. The turbine for a turbocharger according to claim 6, wherein the third tapered surface forms an angle of not smaller than 10 angular degrees and not greater than 40 angular degrees with the radial direction.

8. The turbine for a turbocharger according to claim 6, wherein the back-surface side member includes a first tapered surface formed to be oblique with respect to the radial direction so as to become closer to the back surface of the turbine impeller inward in the radial direction, and wherein an outermost peripheral portion of the first tapered surface is included in a region surrounded by a first line obtained by inclining a tangent to the hub-side wall surface passing a radially inner end of the third tapered surface by 10 angular degrees in a direction farther from the shroud-side wall surface in the axial direction and a second line obtained by inclining the tangent to the third tapered surface by 10 degrees in a direction closer to the axial direction toward the shroud-side wall surface.

9. A turbine for a turbocharger, comprising:

a turbine impeller coupled to a compressor impeller via a rotational shaft;

a turbine casing disposed so as to cover the turbine impeller, the turbine casing including a scroll flow passage and a scroll outlet portion disposed on an inner side, in a radial direction, of the scroll flow passage, for guiding exhaust gas from the scroll flow passage to the turbine impeller; and a back-surface side member disposed so as to face a back surface of the turbine impeller, wherein the back-surface side member includes a protruding portion disposed on an impeller facing surface which faces the back surface of the turbine impeller, the protruding portion protruding toward the back surface and extending in a circumferential direction, and wherein the protruding portion is configured to contract a flow of the exhaust gas flowing into a gap between the back surface and the impeller facing surface from the scroll outlet portion, wherein the impeller facing surface of the back-surface side member includes:

a first region which is positioned at an outer side, in the radial direction, of the protruding portion and which extends in the radial direction;

a second region extending along an axial direction from the first region toward the back surface and forming a part of an outer surface of the protruding portion; and a third region positioned at an inner side, in the radial direction, of the second region, the third region forming another part of the outer surface of the protruding portion.

10. The turbine for a turbocharger according to claim 9, wherein the back-surface side member includes a heat shield plate disposed so as to face the back surface of the turbine impeller.

11. A turbocharger, comprising:

the turbine according to claim 9; and a compressor including the compressor impeller, the compressor being configured to be driven by the turbine.

* * * * *